US005729842A

United States Patent [19]

McCarthy

[11] Patent Number: 5,729,842

[45] Date of Patent: Mar. 24, 1998

[54] REAR LOADED WHEELCHAIR AND METHOD OF REAR LOADING A WHEELCHAIR

[76] Inventor: James Brian McCarthy, 1375 Rainbow, Saginaw, Mich. 48603

[21] Appl. No.: 304,777

[22] Filed: Sep. 12, 1994

[51] Int. Cl.[6] ..... A61G 7/08

[52] U.S. Cl. ..... 5/81.1; 5/86.1

[58] Field of Search ..... 5/81.1, 84.1, 86.1; 414/921; 280/680

[56] References Cited

U.S. PATENT DOCUMENTS

| | | | |
|---|---|---|---|
| 2,694,437 | 11/1954 | Glaser | 155/30 |
| 3,865,427 | 2/1975 | Delany | 414/921 |
| 4,155,588 | 5/1979 | Danziger et al. | 5/81.1 |
| 4,170,368 | 10/1979 | Southward et al. | 280/242 |
| 4,278,387 | 7/1981 | Seguela et al. | 414/921 |
| 4,323,133 | 4/1982 | Williams | 180/65 R |
| 4,354,791 | 10/1982 | Antonellis | 414/921 |
| 4,393,529 | 7/1983 | Britz | 5/81.1 |
| 4,671,730 | 6/1987 | Gateau | 414/921 |
| 4,717,169 | 1/1988 | Shaffer | 280/648 |
| 4,728,119 | 3/1988 | Sigafoo | 280/650 |
| 4,737,997 | 4/1988 | Lamson | 5/81 |
| 4,826,196 | 5/1989 | Kirkpatrick et al. | 280/650 |
| 4,852,899 | 8/1989 | Kueschall | 280/250.1 |
| 4,987,620 | 1/1991 | Sharon | 5/81.1 |
| 4,997,200 | 3/1991 | Earls | 280/648 |
| 5,112,069 | 5/1992 | Aldus et al. | 280/650 |
| 5,112,076 | 5/1992 | Wilson | 5/81.1 |

*Primary Examiner*—Michael J. Milano
*Attorney, Agent, or Firm*—John J. Swartz

[57] ABSTRACT

A rear loaded and unloaded wheelchair and method for transferring a patient between a bed and a wheelchair through the rear of the wheelchair. The wheelchair includes a wheeled main frame, a sub-frame rearwardly extensible relative to the main frame to a position overlying the bed. The sub-frame is vertical moveable on the main frame to raise and lower the sub-frame to a position adjacent the bed and a position removed from the bed. A patient supporting chair is rotatably mounted on the sub-frame for rolling movement between a forward position and a rearward position adjacent the bed cantileverly supported on the main frame via the sub-frame. The chair includes a frame having laterally spaced apart rails and upstanding back rails. The side seat rails detachably mount a seat on which a person will sit while seated on a bed. The back support is moveably mounted on the back frame members between a lowered back supporting position and a raised position overlying a patient seated on a bed allowing the seat frame to be moved to a position rearwardly of the patient sitting on the bed. Transferring a patient from the wheelchair to the bed is accomplished by reversing the above procedure.

75 Claims, 21 Drawing Sheets

44
51
54
55
53
58a
16
57a
64
66
65
60
62
59a
61
F2
F1
57
58
56
15
69
72
74
70
71
73
67
68
50

126

24
127a
129a
128a
127
129
128
25
25
126
140
300°

126
124
128a
128

REAR LOADED WHEELCHAIR AND METHOD OF REAR LOADING A WHEELCHAIR

BACKGROUND OF THE INVENTION

1. Field of the Invention

This invention relates to a wheelchair and method of rear loading a wheelchair and more particularly to a rear loaded and unloaded wheelchair which can transfer, without manually lifting, a bedridden patient to and from a wheelchair.

2. Description of the Prior Art and Objects

A wheelchair typically includes a wheeled frame on which a chair is provided with a back rest, a seat, and adjustable leg rests. The chair frame is mounted on wheels which can be locked to prevent movement during transfer of a patient to and from the wheelchair. Unfortunately, many patients are unable to self-transfer and thus require an attendant. Sometimes an attendant is not always available and if available, such an attendant is normally quite expensive. Moreover, the attendants frequently injure their spines by lifting such patients between the wheelchair and the bed.

The inability to self transfer often is the cause of a person being unable to receive attendant care in a home setting by a family member. Such patients are generally forced to live in a nursing home to obtain appropriate attendant care. Such nursing home care is relatively expensive. Many individuals are psychologically adversely affected in a nursing home and would be much happier if cared for by a family member in their own home. Accordingly, it is an object of the present invention to provide a new and novel wheelchair which will eliminate the necessity of manually lifting a person being transferred to and from a wheelchair.

It is another object of the present invention to provide a new and novel wheelchair which includes a backloading mechanism on a main frame for forwardly moving a seat, and a person thereon, forwardly from a bed relative to the main frame through the rear end of the main frame to be supported thereon without the need of an attendant manually lifting the person.

The loading of a patient to a wheelchair has heretofore been accomplished by manually lifting a person to his feet, rotating the person 90° and then lowering the person into the wheelchair. It is yet another object of the present invention to provide a wheelchair which includes mechanism for loading and unloading a person through a rear opening in the wheelchair.

It is still another object of the present invention to provide a new and novel rear loaded wheelchair which will minimize injuries to an attendant transferring patients to and from wheelchairs.

It is a further object of the present invention to provide a new and novel wheelchair which can be loaded and unloaded by a relatively unskilled individual.

It is another object of the present invention to provide a rear loaded and unloaded wheelchair which includes a main frame and a sub-frame extensible rearwardly outwardly beyond the main frame to a position adjacent a bed.

It is yet another object of the present invention to provide a rear loaded and unloaded wheelchair of the type described including a seat mounted for rolling movement on an extensible and contractible track which extends rearwardly of the main wheel chair frame.

A still further object of the present invention is to provide a rear loaded and unloaded wheelchair of the type described including a wheelchair frame having side rails mounting a body support member therebetween for movement between a position supported by the frame and a removed position in which a person seated on a bed can pass therebetween.

Another object of the present invention is to provide a rear loaded and unloaded wheelchair of the type described which includes a main frame, a sub-frame mounted on the main frame for vertical movement, a chair supporting track mounted on the sub-frame for extensible and retractable movement between a forward position and a rearwardly extended position, a chair frame mounted on the track for movement thereon between a forward frame supported position and a rearward, cantileverly supported transfer position, and a seat detachably mounted on the chair frame for transferring a patient supported, in a seated position, by the seat to and from a bed, couch, automobile seat, etc.

U.S. Pat. No. 4,737,997 issued to Philip Lamson on Apr. 19, 1988, illustrates one prior art wheelchair having a wheeled frame that is coupled to a bed supported seat but there is no disclosure or suggestion in this patent of moving the chair forwardly or upwardly relative to the wheeled frame through an opening in the wheeled frame to a safe transport position overlying the wheeled frame. This prior patent does not disclose the concept of tracks which are extensible rearwardly from a main frame and rollingly support a chair frame for movement thereon between a forward, transport position and a rearward, cantileverly supported position.

It is another object of the present invention to provide a wheelchair provided with a wheelchair frame having a back support that is moveable upwardly on the back support frame thus allowing the wheelchair frame to pass over the head and to the rear of a person seated on a bed.

Yet another object of the present invention is to provide a rear-loaded wheelchair of the type described including new and novel pulley and cable drive mechanism for vertically moving a chair and chair support frame on a main frame.

Still another object of the present invention is to provide a wheelchair of the type described including a new and novel vertical transfer system which is sufficiently durable to raise and lower the sub-frame but which includes compacting features that permit the wheelchair to roll through a standard 30 inch door opening.

It is a further object of the present invention to provide a wheelchair of the type described which includes a mechanism for raising and lowering a wheelchair sub-frame which is sufficient internally in width to allow a person to sit comfortably thereon but sufficiently externally narrow to permit the wheelchair to roll through a standard 30 inch door opening.

It is still a further object of the present invention to provide a wheelchair of the type described which includes a new and novel cable and pulley lift structure that includes cables with terminal ends which are vertically staggered and coupled to a lift pulley.

Other objects and advantages of the present invention will become apparent to those of ordinary skill in the art as the description thereof proceeds.

SUMMARY OF THE INVENTION

Rear loading and unloading method and apparatus for transferring a person between a bed and a wheeled frame having front and rear ends adapted to traverse a support surface comprising: a main frame assembly having a front end, a rear end, and mechanism for transitional movement over a support surface; a seat configured and maneuverable to support a person in a forwardly facing direction on a bed with the person's legs over hanging the side of a bed; mechanism for back loading the seat and any person supported on the seat, through the rear end of the main frame assembly to be supported by the main frame assembly for movement therewith including a seat frame; mechanism for detachably coupling the seat to the seat frame to be carried therewith, a secondary frame assembly for supporting the seat frame on the main frame assembly for forward and rearward movement between a rearward transfer position, rearward of the main frame and adjacent the seat on the bed, and a forward transport position; the secondary frame assembly being extensible and contractible on the main frame between a rearwardly disposed position, relative to the main frame assembly to cantileverly support the seat rearward of the main frame assembly, and a forward position.

DESCRIPTION OF THE DRAWINGS

The invention may be more readily understood by referring to the accompanying drawings, in which:

FIG. 26 is a rear perspective view illustrating a rear loaded and unloaded wheelchair constructed according to the present invention disposed adjacent a patient's bed;

FIG. 27 is a view similar to FIG. 26 illustrating a subsequent step in the transfer of a patient and illustrates the cloth seat of the chair removed and placed on the bed with a person being rolled to a position on the cloth seat on the bed and the cloth back support being moved to an adjusted raised position;

FIG. 28 is a similar rear perspective view illustrating a subsequent step in the transfer and more particularly illustrates the adjustable track assembly rearwardly extended to a transfer position and stabilizers being rearwardly extended;

FIG. 29 is a similar rear perspective view illustrating a subsequent step in the transfer wherein the wheelchair, constructed according to the present invention, is moved more nearly adjacent the bed so that the stabilizing bars are disposed beneath the bed and the extended portion of the adjustable track assembly is astride the patient's thighs;

FIG. 30 is a similar rear perspective view of a rear loaded and unloaded wheelchair in a subsequent step in the transfer sequence and more particularly illustrates the rolling chair in a rearward, cantileverly supported transfer position on the extended track;

FIG. 31 is a similar rear perspective view of a rear loaded and unloaded wheelchair constructed according to the present invention and more particularly illustrates a subsequent step in the transfer sequence with the chair being lowered to a position adjacent the upper side of the bed, the cloth seat being clamped to the lowered seat frame, and the cloth back support being lowered and clamped in a back supporting position;

FIG. 32 is a similar rear perspective view illustrating a subsequent step in the sequence and more particularly illustrates a patient having been moved forwardly away from the bed to a rest position sitting in the wheelchair with the track assembly and with stabilizing bars retracted.

DESCRIPTION OF THE PREFERRED EMBODIMENT FRAME

Figure 1:
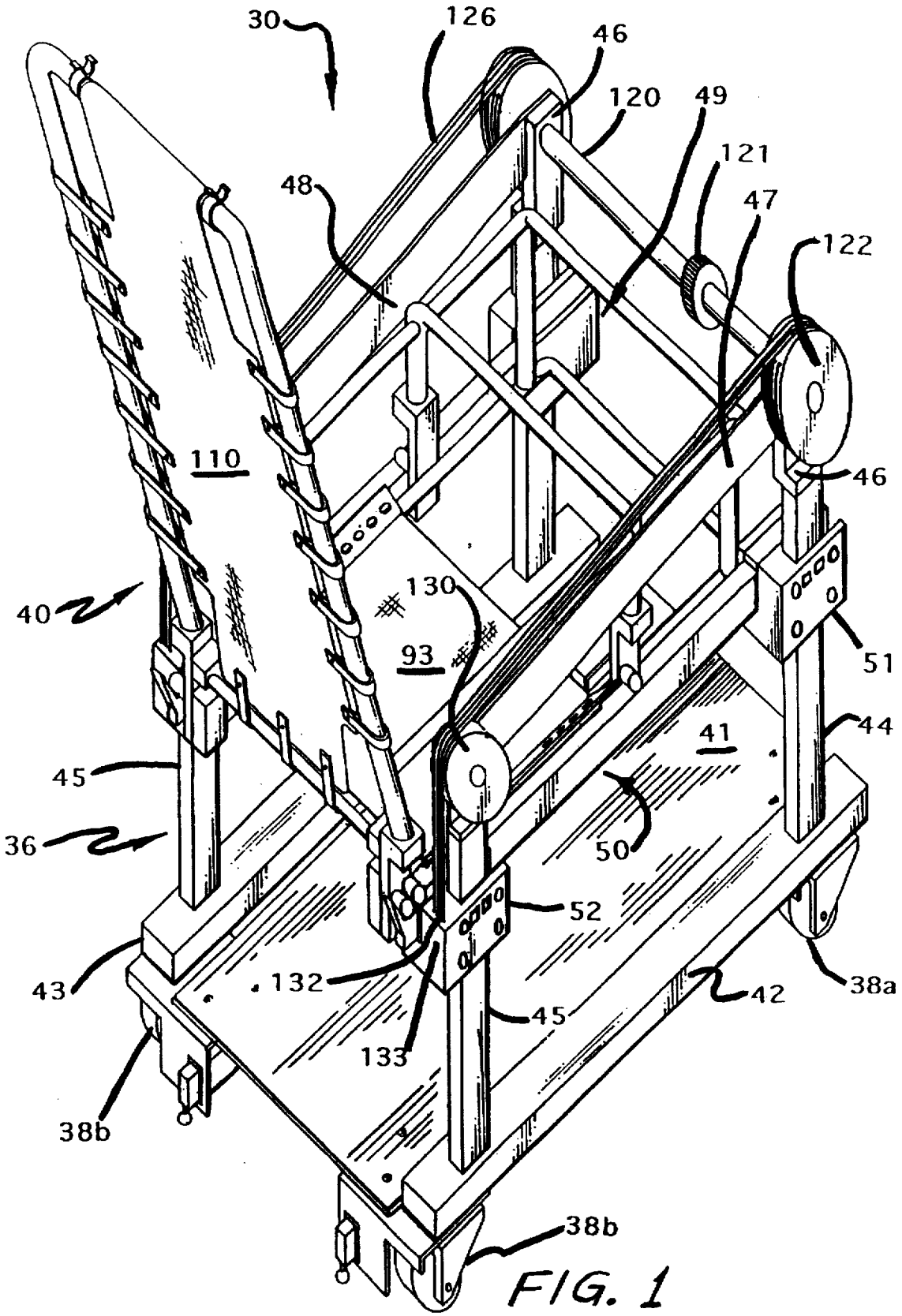
FIG. 1 is a rear perspective view of a rear loaded and unloaded wheelchair constructed according to the present invention.

A rear loaded and unloaded wheelchair, generally designated 30, is particularly adapted for use in transferring a bed ridden patient, generally designated 32 (FIG. 27), to and from a bed, generally designated 34. The wheelchair 30 includes a main frame, generally designated 36, mounted on wheels, generally designated 38, for rolling movement along a support surface, generally designated 37 (FIG. 3). The wheelchair 30 also includes a chair, generally designated 40, mounted for rolling movement on the frame 36 for movement between a forward, rest or transport position, illustrated in FIG. 2, and a rearward, patient transfer position illustrated in FIG. 3.

The main frame 36 includes a pair of lower, laterally spaced apart lower frame bars 42 and 43 mounted on pairs of front and rear wheel caster assemblies 38*a* and 38*b*, respectively. The frame 36 includes front and rear pairs of upstanding frame bars 44 and 45, respectively, projecting upwardly from the front and rear ends, respectively, of the frame bars 42 and 43. Frame bars 42 and 43 are spanned by a horizontal platform, generally designated 41, which rigidities the frame and provides a foot rest for the patient 32. Welded or otherwise suitably fixed to the upper ends of the upstanding posts 44 and 45, are L-shaped pulley mounts 46 spanned by laterally spaced apart, longitudinally extending upper side frame bars 47 and 48 defining a rearwardly U-shaped opening, patient receiving slot S therebetween for receiving a patient 32 as the patient is moved forwardly through the rear end of the main frame 36.

Figure 4:
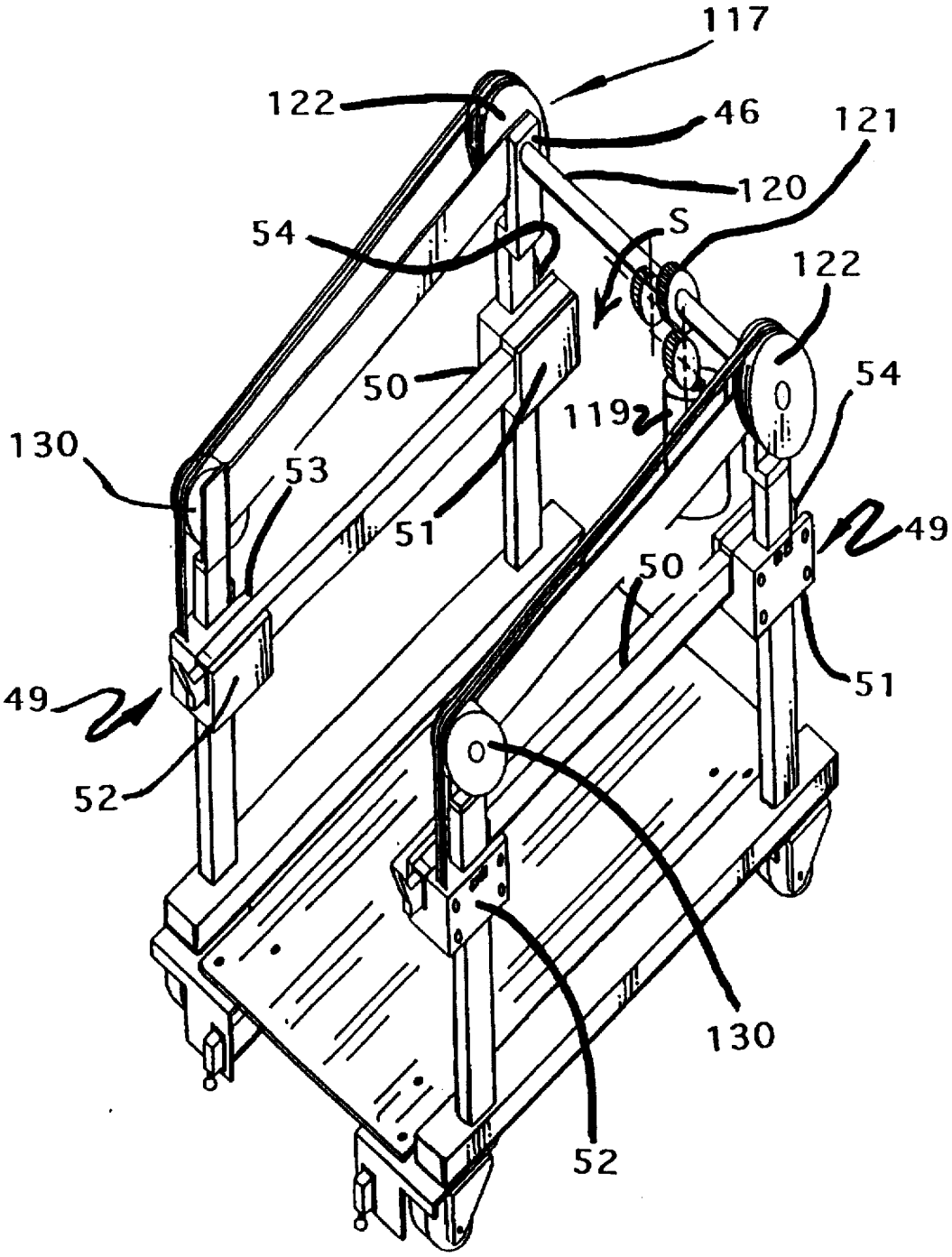
FIG. 4 is a rear perspective view of the wheelchair frame and sub-frame only, with the chair assembly being removed for purposes of clarity.

Mounted for vertical movement on the main frame assembly 36 is a sub-frame assembly, generally designated 49, (FIG. 4) including a vertically adjustable track assembly, generally designated 50. The sub-frame 49 includes laterally spaced apart, front and rear, pairs of front and rear, vertical guide blocks 51 and 52, respectively, each having a forked guide portion 53 defining a forwardly opening guide slot 54 which slidably receives one of the vertical guide posts or tracks 44, 45 for vertical sliding movement thereon. Upper and lower guide wheels 55 and 56 (FIG. 14) are journaled on upper and lower horizontal shafts 57 and 58, respectively, spanning the associated fork guide portion 53 so as to be received in the forwardly opening slots 54 in rolling engagement with the front edge 57*a* of each bar 44, 45. The rollers 55 and 56 also function to capture the guide blocks 51 and 52 on the vertical guide tracks 44 and 45.

A pair of upper and lower rear guide block rollers 58*a* and 59*a* are journaled on upper and lower horizontal shafts 60 and 61, respectively, disposed in openings 62 (FIG. 14) provided in the guide blocks 51 and 52 at the rear of each slot 54. The rollers 58*a* and 59*a* also function to capture the guide blocks 51 and 52 for rolling movement on the vertical guide tracks 44 and 45.

Figures 14, 15, 16:
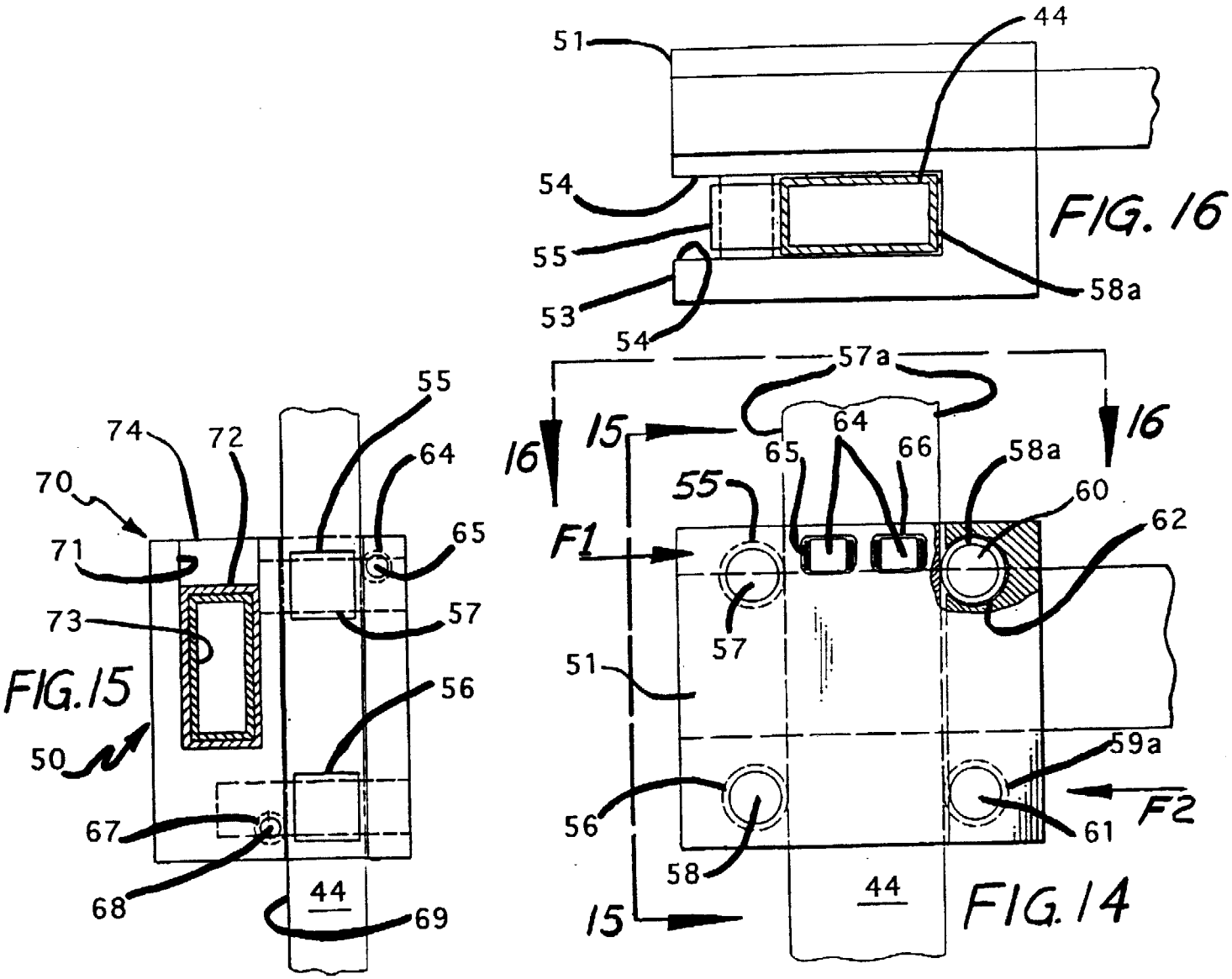
FIG. 14 is an enlarged side elevational view of the front guide block illustrated in the chain line circle 14—14 of FIG. 2, more particularly illustrating the adjustable subframe and track assembly and the construction for guiding the vertical movement thereof on the main frame.
FIG. 15 is a rear sectional view taken along the line 15—15 of FIG. 14.
FIG. 16 is a sectional plan view taken along the line 16—16 of FIG. 14.
Figure 17:
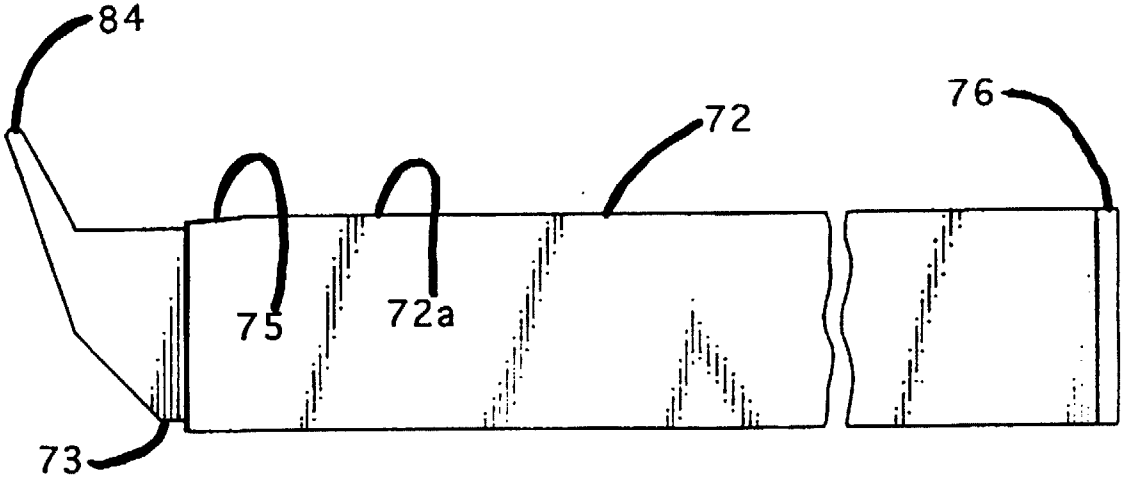
FIG. 17 is an enlarged side elevational view more particularly illustrating the track assembly only in a retracted position.

To further aid vertical movement and prevent the guide blocks 51, 52 from binding on the guide tracks 44, 45, a pair of laterally outer guide rollers 64 are journaled on horizontal shaft 65 disposed in laterally outwardly opening apertures 66 provided in the forked guide portion 53 (FIGS. 14 and 15).

To further preclude undesired lateral canting of the guide blocks 51, 52, additional, laterally inner guide rollers 67 (FIG. 15) are journaled on horizontal shaft 68 on the guide blocks 51, 52 along the laterally inner edge surfaces 69 of the guide posts or tracks 44, 45. The rollers 55, 56, 58*a*, 59*a*, 64 and 67 (FIGS. 14–16) each have a low coefficient of friction which avoids the cone of friction phenomenon and clearly provide free rolling, vertical guiding movement of the blocks 51 and 52 and track 50 on posts 44 and 45. The laterally inner portion 70 of each guide block 51, 52, includes an upwardly opening track receiving slot 71 which receives the track assembly, generally designated 50. The sub-frame 49 and track assembly 50 are vertically moveable on the vertical guide tracks 44 and 45 by apparatus to be described more particularly hereinafter.

CHAIR TRACK

Figure 2:
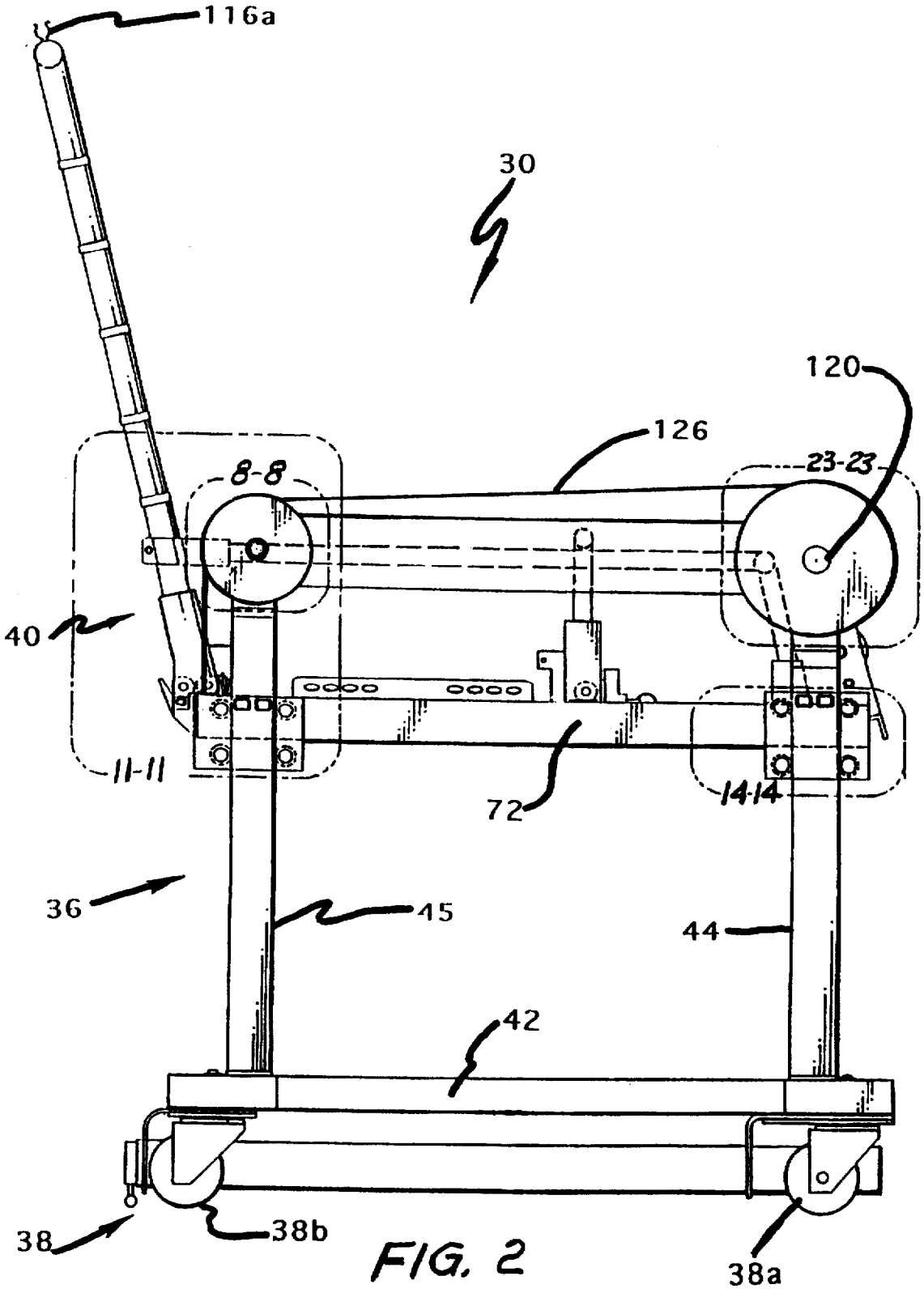
FIG. 2 is a side elevational view thereof with the moveable chair being illustrated on the frame in a forward rest position.
Figure 3:
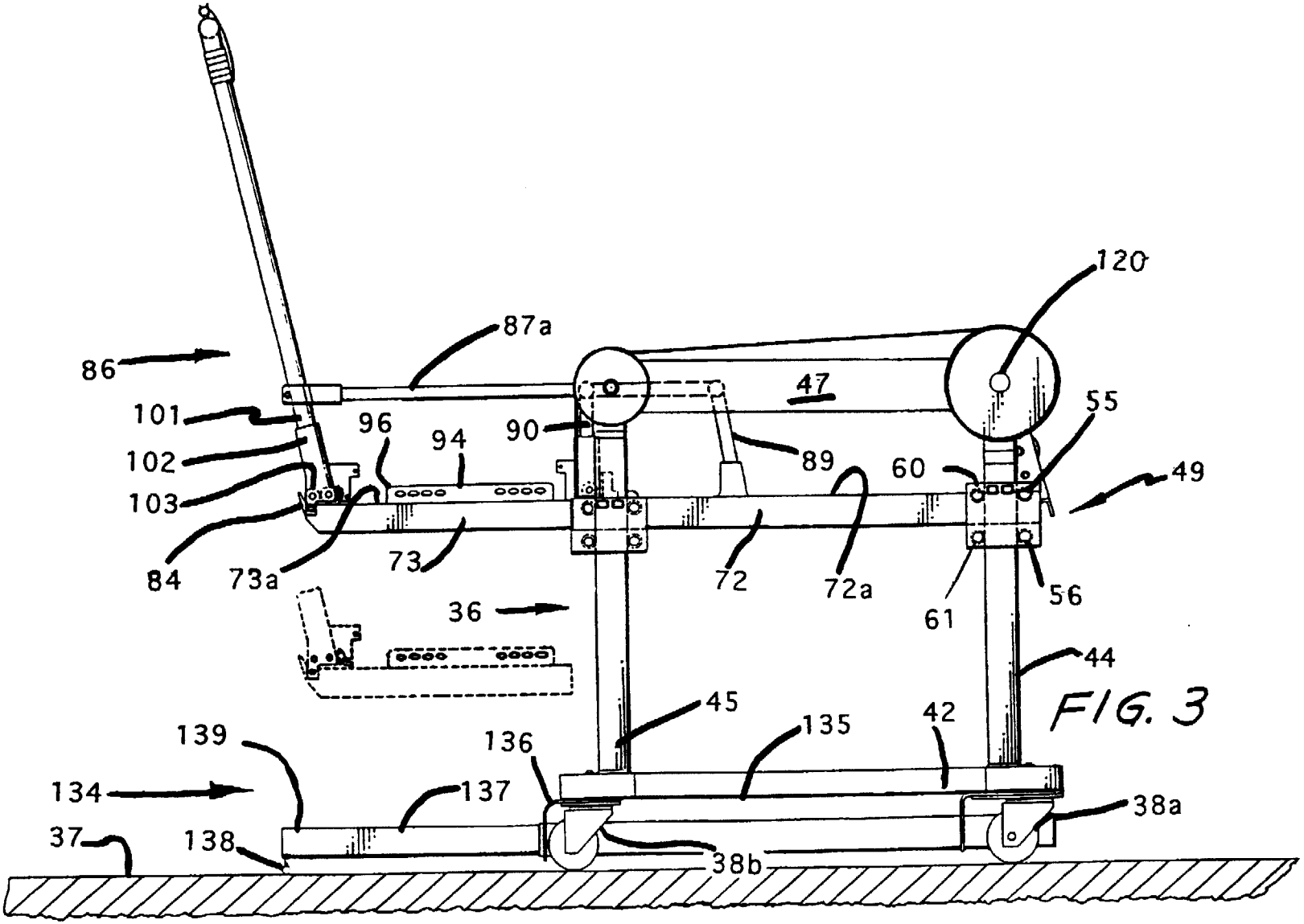
FIG. 3 is a side elevational view similar to FIG. 2 illustrating the chair in a rear, patient transfer position, an adjusted lowered position of the chair being illustrated in chain lines.

Each track assembly 50 includes an outer, forward rectangular tubular track or bar 72 and an inner, rearward, tubular rear track or bar 73 slidably received in the forward tubular track 72 for movement between the forward rest position, illustrated in FIG. 2, and the rear, cantileverly supported transfer position illustrated in FIG. 3. The forward tubular track 72 is received in the guide block slots 71 (FIG. 15) and secured thereon via retainer blocks 74 received in the slots 71, and fixed to the front guide blocks 51, via screws or bolts or the like (not shown).

Figure 18:
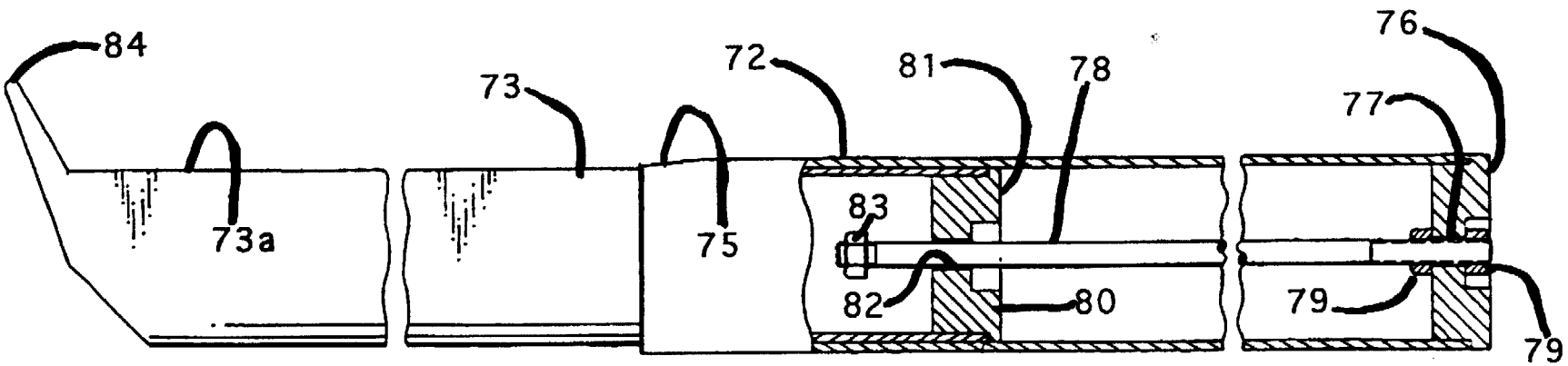
FIG. 18 is a view similar to FIG. 17 but illustrating the track assembly in a rearwardly extended transfer position, part of the front tubular track being broken away to more particularly illustrate the internal portions thereof.
Figure 21:
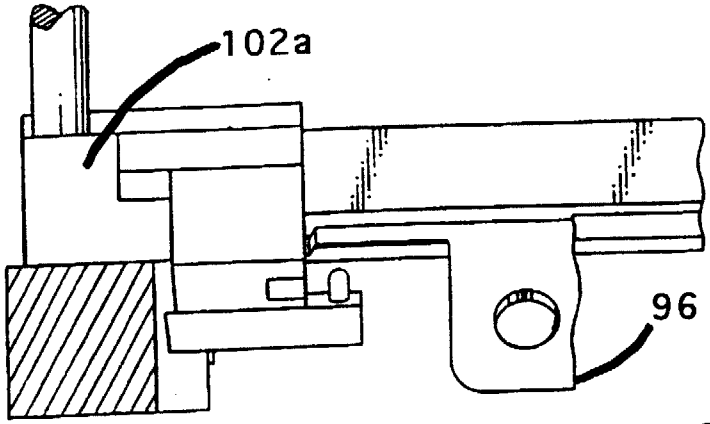
FIG. 21 is a top plan sectional view taken along the line 21—21 of FIG. 19.

The forward end of the forward tubular track 72 is closed by an end plate 76 (FIG. 18) having an aperture 77 therein receiving a stop rod 78 which is fixed to front and rear sides of the end plate 76 via nuts 79 threaded thereon. The front end 80 of the rear tubular track 73 is also closed by a front end plate 81 and includes an opening 82 slidably receiving the rear end of stop rod 78. A rear stop nut 83 is threaded on the rear end of the stop rod 78 for bearing against the plate 81 of the rear inner track 73 to limit the relative rearward movement of the rear inner track 73 relative to the forward outer track 72. The rearward tubular track bar 73 also includes integral, upwardly extending stop flanges 84, to stop the rolling movement of the chair 40 off the rear end of the rear track 73.

THE CHAIR

Figure 7:
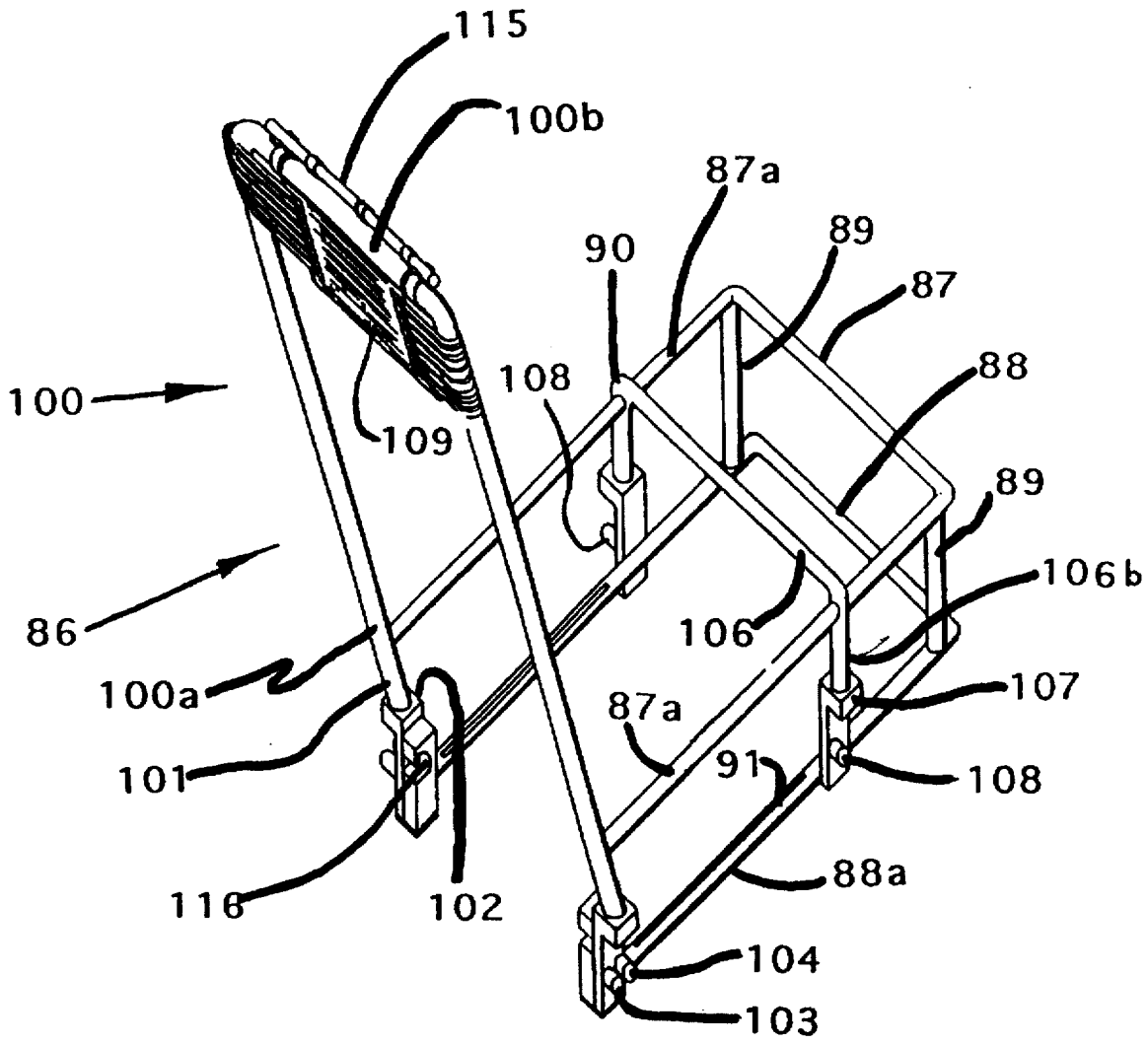
FIG. 7 is a rear perspective view of the rolling chair similar to FIG. 6 but illustrating a cloth seat removed and the back support disposed in an adjusted raised position.
Figure 10:
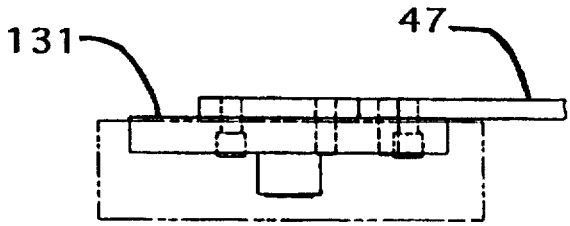
FIG. 10 is a top plan view of the rear pulley taken along the line 10—10 of FIG. 8.
Figures 11, 12, 13:
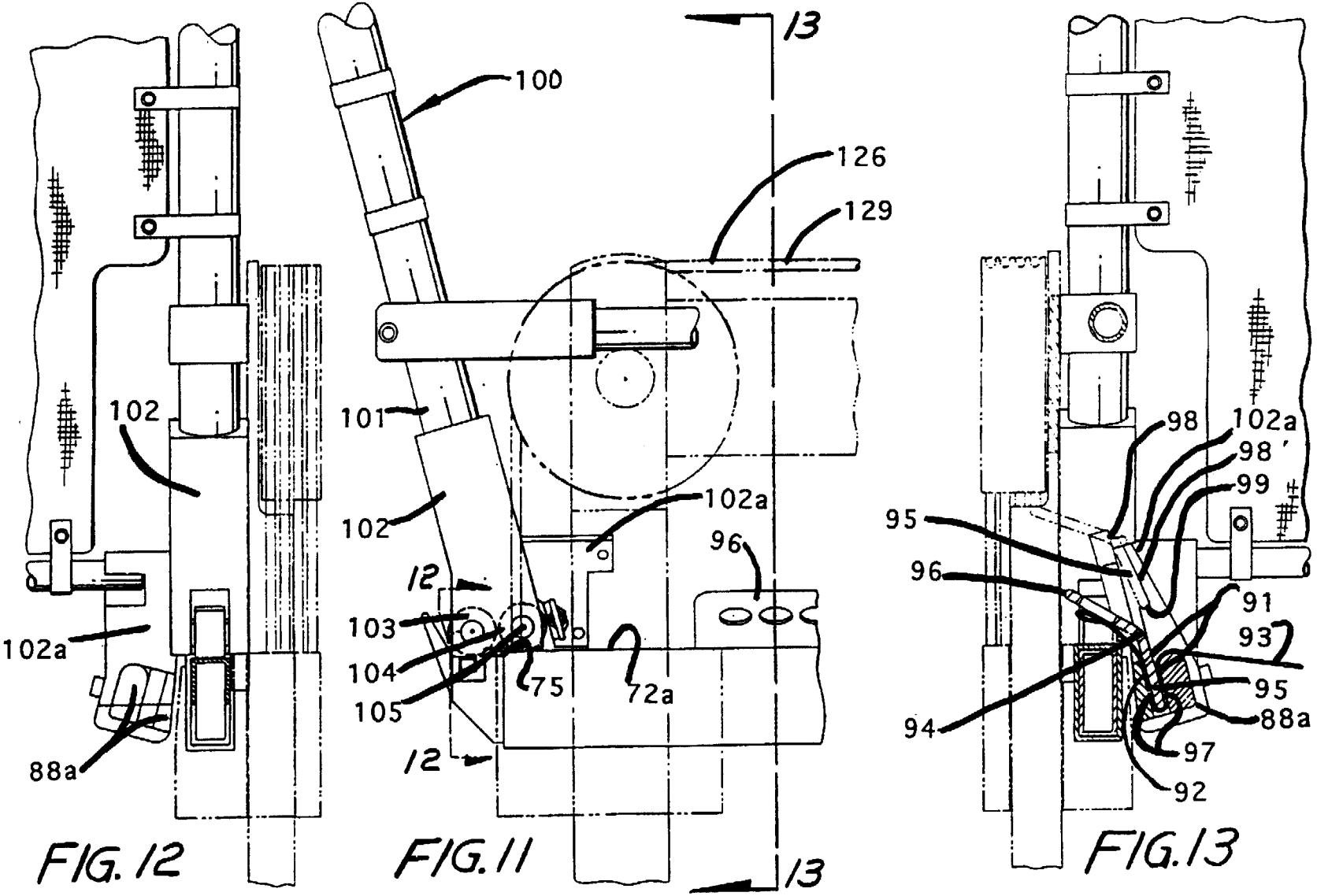
FIG. 11 is an enlarged side elevational view of the apparatus illustrated in the chain line rectangle 11—11 of FIG. 2.
FIG. 12 is a rear sectional view taken along the line 12—12 of FIG. 11.
FIG. 13 is a front sectional view taken along the line 13—13 of FIG. 2.
Figure 22:
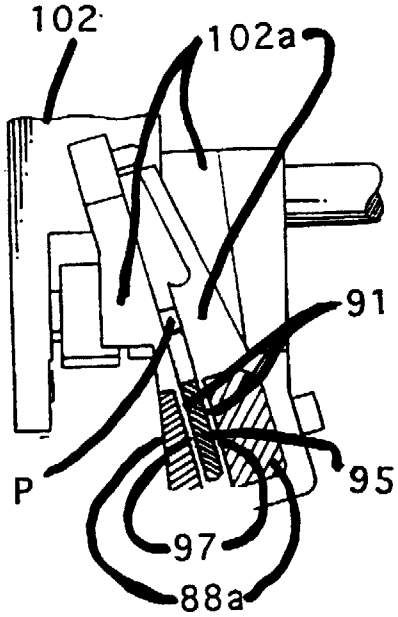
FIG. 22 is a front sectional rear view taken along the line 22—22 of FIG. 19.
Figure 20:
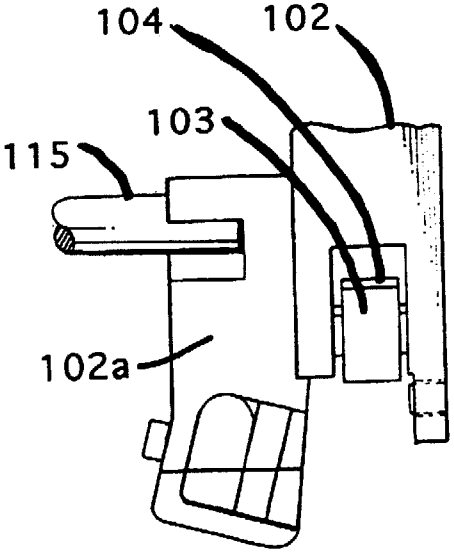
FIG. 20 is a rear elevational view of the apparatus illustrated in FIG. 19.

Referring now more particularly to FIGS. 6, 7, 11–13, and 20–22, the chair 40 includes a chair frame, generally designated 86, including upper and lower U-shaped, horizontally disposed, frame bars 87 and 88 held in vertically spaced apart relation by front spacer frame bars 89 and intermediate, U-shaped spacer frame bars 90 (FIG. 7). The laterally spaced apart legs 88*a* of the lower, rearwardly opening, U-shaped chair frame bar 88 each includes an upwardly and laterally outwardly vertically inclined slot 91 for receiving a lateral edge portion 92 of a cloth seat, generally designated 93 (FIGS. 13 and 22).

Figure 19:
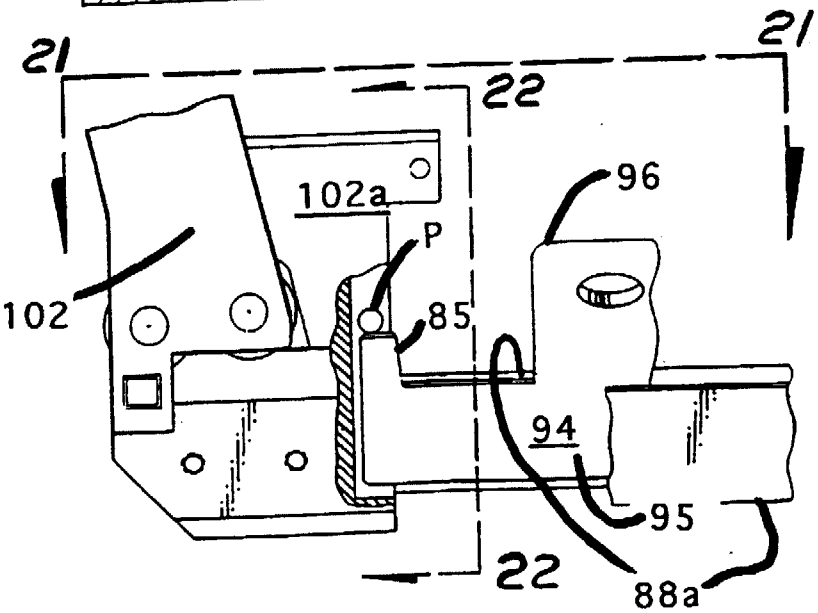
FIG. 19 is an enlarged side elevational view similar to FIG. 11, but illustrating the rear of the rolling chair only and the construction for clamping the cloth seat, part of the chair side rail being broken away to more particularly illustrate the seat wedge.

The lateral seat edges 92 are held in the chair slot 91 via a pair of laterally spaced, plate wedges, generally designated 94, having a longitudinally extending lower plate portion 95 which is received in the slot 91 to sandwich each lateral seat edge 92 in the position illustrated in FIGS. 13, 19 and 22. The wedge 94 also includes an integral, laterally outwardly displaced, upper hand gripping portion 96, as illustrated. The slots 91 are angled upwardly outwardly (FIGS. 13 and 22) so that when the person 32 sits on the seat to exert a downward force thereon, the corresponding and opposite upward force exerted by the lateral seat portions 92 on the wedge 94 will be absorbed by the laterally inwardly adjacent portion 97 of the rails 88*a*.

The chair side rails 102*a* also include upstanding rests 98 having a longitudinal groove 99 for receiving the lower wedge portion 95 (as illustrated in chain lines at FIG. 13) when the wedge 94 is removed to release the seat edges 92 from the position illustrated in solid lines in FIG. 13.

The chair frame 86 also includes a downwardly opening U-shaped back rest frame bar, generally designated 100, having lower ends 101 fixed to lower terminal blocks 102 which, in turn, are fixed to the rear ends of the laterally outer sides of lower, side frame bars 88*a*. It should be noted, as illustrated in FIG. 7, for example, that the U-shaped frame bars 100 are slightly vertically inclined.

The lower frame blocks 102 each have an inverted L-shape and each is provided with a rear, lower roller 103 for riding on the upper surface 73*a* of rear track 73 when the seat is in the rearward transferred position, illustrated in FIG. 3.

The mounting block 102 also mounting an upper, forwardly disposed roller 104 (FIG. 11) journaled on a block supported shaft 105 which is slightly forward and above the roller 103 and bears against and is supported by the upwardly forwardly inclined surface or ramp 75 (FIG. 18) at the rear end of the upper front track surface 72*a*.

The upper, forward chair rollers 104 will bear against the ramp surface 105 to raise the wheels 103 from a position supported by the rear track surfaces 73 so that the entire chair 40 is supported by the front rails 72 only when the chair 40 is in the forward position illustrated in FIG. 2 and 11. This now permits free extension and retraction of track 73 inside track 72.

Also provided for mounting the chair 40 for rolling movement on the track 72 is the downwardly opening, U-shaped frame bar 90 (FIG. 7) having an upper portion 106, spanning the legs 87*a* of the upper U-shaped frame bar 87, and a pair of downwardly inclined laterally spaced apart vertical legs 106*b* terminating in inverted L-shaped roller mounting terminal portions 107 which are fixed to the laterally outer sides of the legs 88*a* of the lower bar 88. Roller wheels 108 are journaled on the blocks 107 via shafts fixed to the laterally outer side of mounting portions 107.

The back frame 100 (FIG. 6) has legs 100a depending from an upper cross bar 100*b*. A back support cloth, generally designated 109, is mounted on the frame 100 and includes a vertical sheet 110 having a plurality of perimetrically spaced eyelets 111 which receive ties 112 which slidingly receive the legs 100*a* of the frame 100. The upper edge 113 of the sheet 110 is folded back on itself to form a loop which receives the bar 100*b*. The lower end 114 of the sheet 110 includes a plurality of eyelets 111 and 111*a* and ties 112*a* which are looped around a tie down bar 115 which is detachably received and locked in rearwardly opening openings 116 (FIG. 7) provided on blocks 102*a* fixed to the inner sides of frame mounting blocks 102. The bar 115 can be moved downwardly to stretch the sheet 110 taut on the frame 100. If the bar 115 is removed from the slots 116, the entire sheet 110 may be moved upwardly with the side frame ties 112 sliding on the bar legs 100*a* to upwardly move the sheet 110 from the back supporting position illustrated in FIG. 6 to the raised position illustrated in FIG. 7. Mounted atop the top cross bar 100*b* are a pair of clips, generally designated 116*a*, for mounting the bar 115 in the raised position illustrated in FIG. 7.

As illustrated in FIG. 19, the wedge members 94 include a rearward portion 85 which is received beneath a pin P provided on a plate 102A fixed to the laterally inner side of mounting block 102 (FIG. 12 and 20) to preclude upward movement of the wedge member 94 once it has trapped the cloth seat in the seating position.

DRIVE APPARATUS

Figure 5:
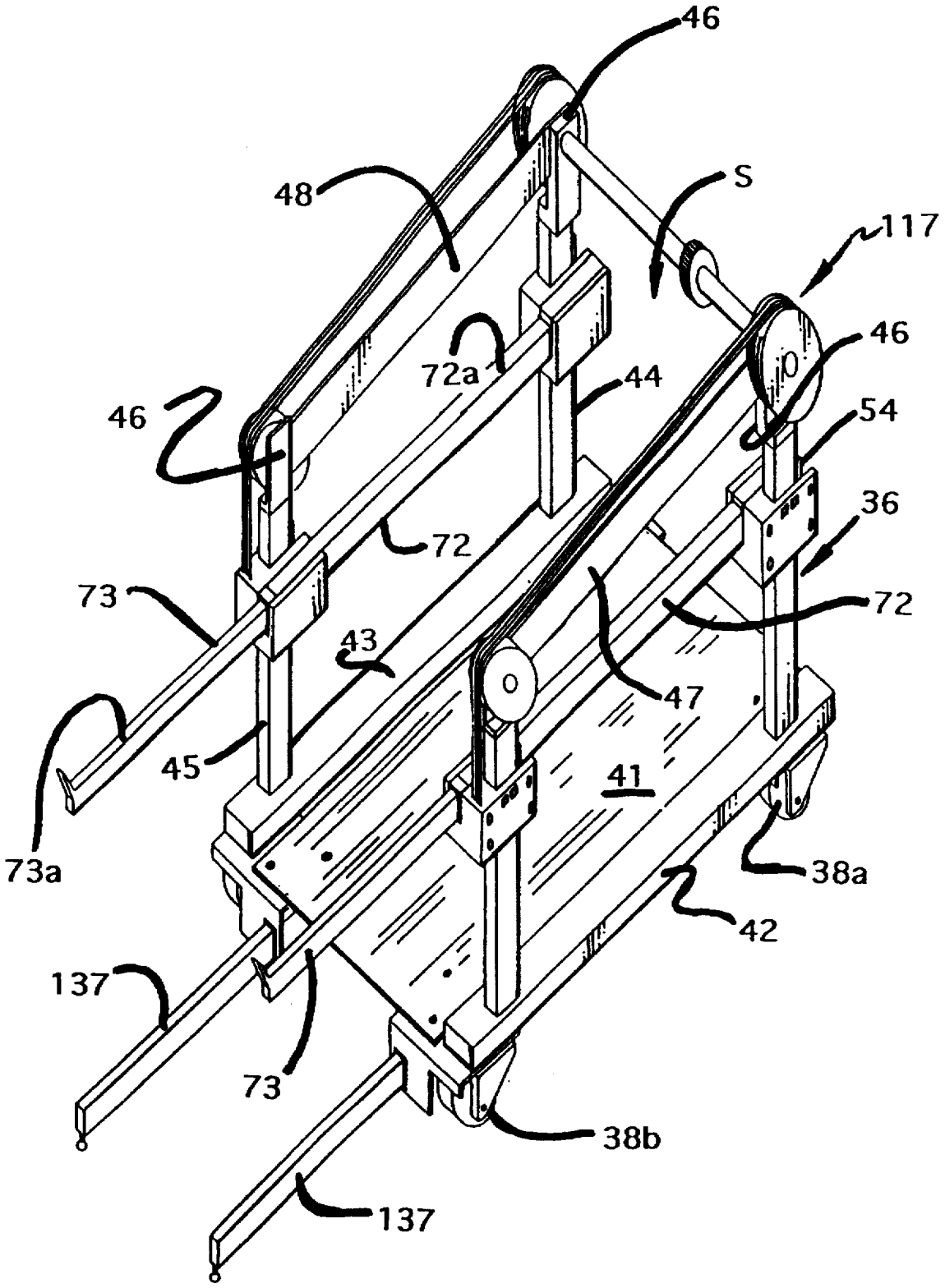
FIG. 5 is a rear perspective view, similar to FIG. 4, illustrating a chair supporting track assemblies and stabilizing members in an extended patient transfer position rearward of the main frame.
Figure 6:
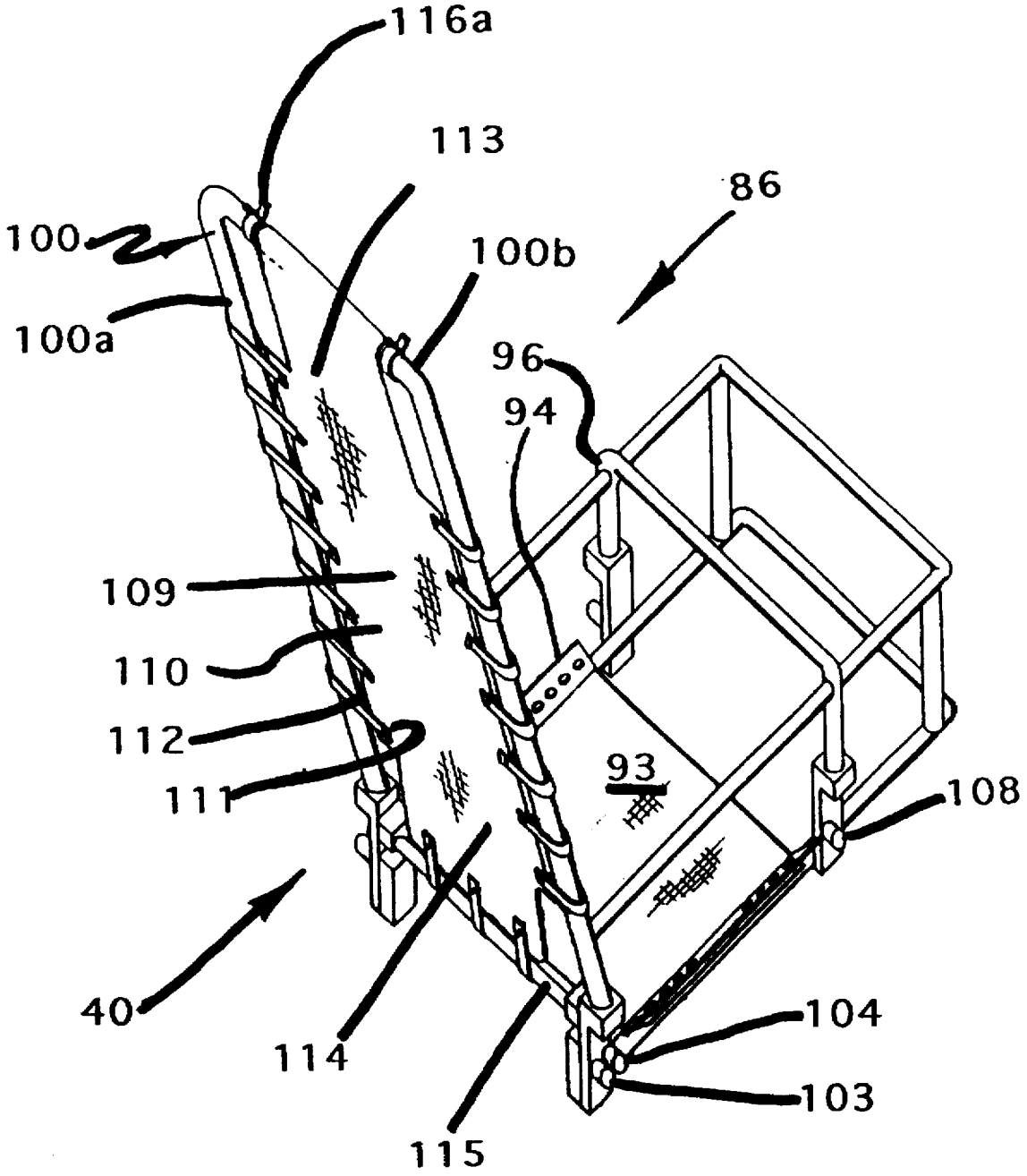
FIG. 6 is a rear perspective view illustrating only the patient chair which is rollingly supported on the frame assembly illustrated in FIGS. 4 and 5, the rests for the seat clamps being omitted for purposes of clarity.

Apparatus, generally designated 117 (FIGS. 4 and 5), is provided for vertically moving the sub-frame 49 and track assembly 50 between the raised positions, illustrated in solid lines in FIG. 3, and the lower transfer position illustrated in chain lines in FIG. 3 and includes a forward drive shaft, generally designated 120, journaled in the forward L-shaped pulley mounts 46 and coupled to a drive motor, schematically designated 119 via a drive gear 121. The drive motor may suitably comprise a DC motor driven by a DC battery (not shown).

Figures 23, 24, 25:
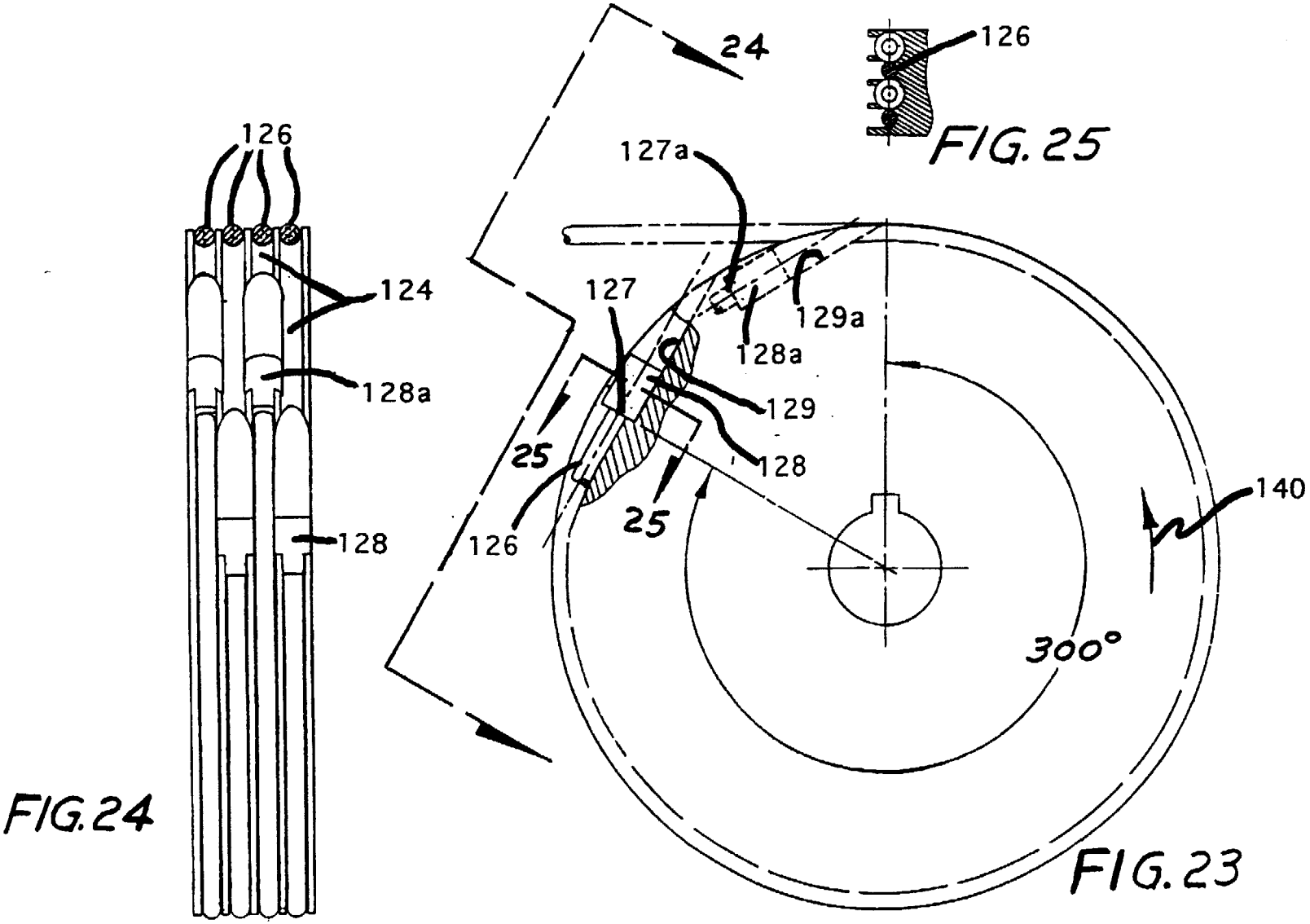
FIG. 23 is an enlarged side elevational view of the front pulley illustrated in the chain line circle 23—23 of FIG. 2, parts of the pulley being broken away to more particularly illustrate the anchor structure for coupling the cables to the pulley.
FIG. 24 is a "rolled out" end view more particularly illustrating the structure for coupling the lift cables to the front pulley illustrated in FIG. 23 taken along the line 24—24 of FIG. 23.
FIG. 25 is a sectional end view taken along the line 25—25 of FIG. 23.
Figure 26:
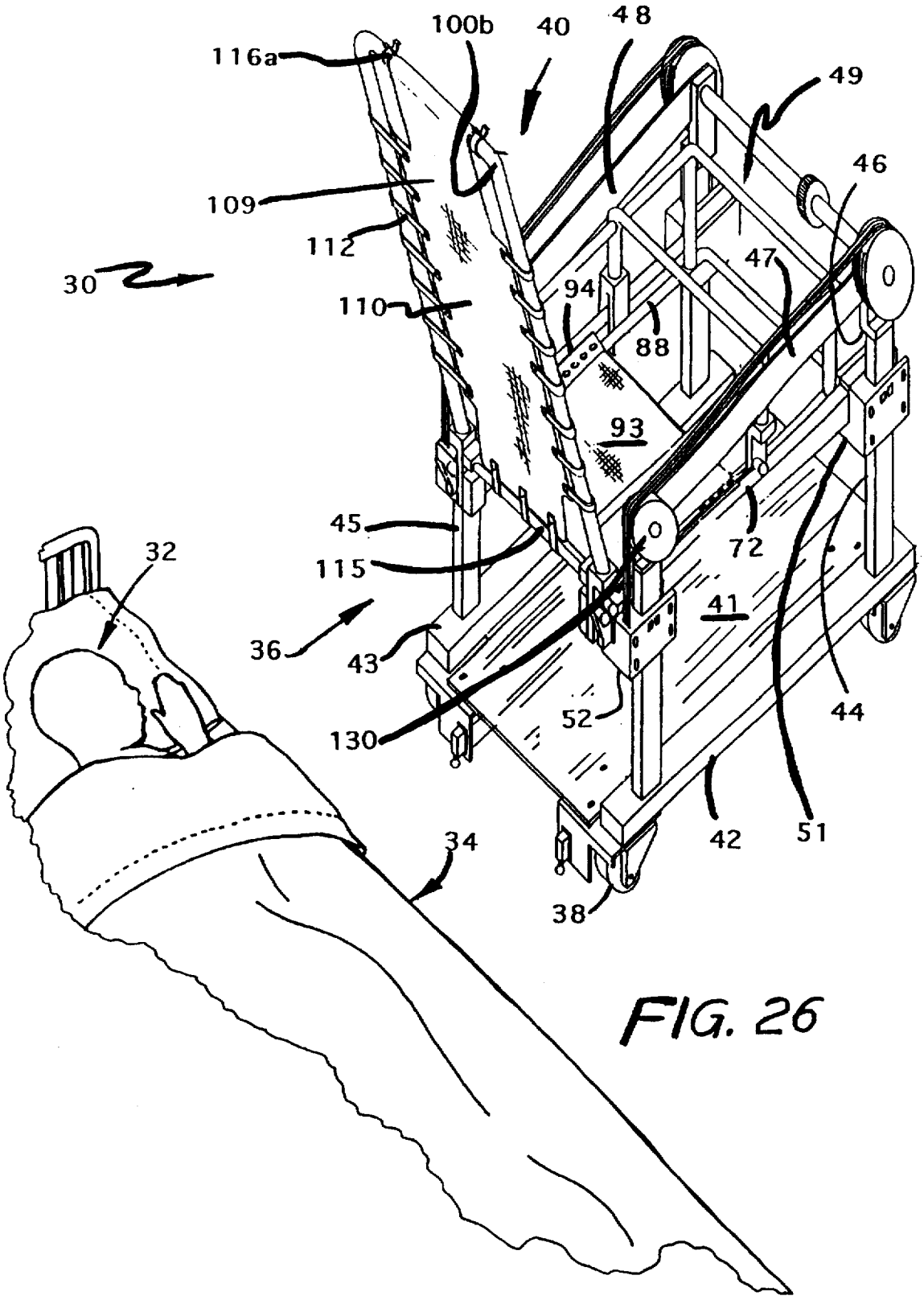
FIGS. 26–32 illustrate sequential steps in the transfer of a patient from a bed through the rear of a wheelchair to be supported thereon for transport and more particularly.

Mounted on the laterally outer terminal ends of the drive shaft 120 is a pair of drive pulleys 122 having a plurality of laterally spaced apart annular grooves 124 (FIGS. 23 and 24) for receiving a plurality of individual drive cables 126 which have terminal ends 127 that are longitudinally staggered, as illustrated in FIGS. 23 and 24, and are fixed to enlarged steel cylinders 128 which are received in enlarged openings 129 provided in the peripheral surface of the pulley 122. Alternate ones 127*a* of the cables are coupled to alternate terminal blocks 128*a* which are received in circumferentially spaced enlarged grooves 129*a*. The steel cylinders 129 are attached to cables 126 at the ends 127 and 127*a* and are assembled into circular slots 129 and 129*a* milled into the cable grooves. As the pulleys 122 rotate in the counter clockwise direction, represented by the arrows 140, the cables will be moved rearwardly to the left as illustrated in FIG. 23. The terminal ends of the cables are circumferentially staggered in order to minimize the width of the pulleys 122 and 130 which would otherwise be required if the steel cylinders 129 and 129*a* were side-by-side. The staggered cable design allows the drive pulleys 122 to be rotated 300 degrees about the axis of shaft 120 before the cable ends 129*a* collide with the straight run of the cables. The size of the cable is predicated upon the degree of vertical travel for the sub-frame 49. For a 20 inch vertical travel, for example, required by the sub-frame frame 49 and chair 40 mounted thereon, the pulley diameter is calculated according to the following formula:

Pulley 122 diameter=vertical travel×360° divided by (3.1416×300°).

Figure 9:
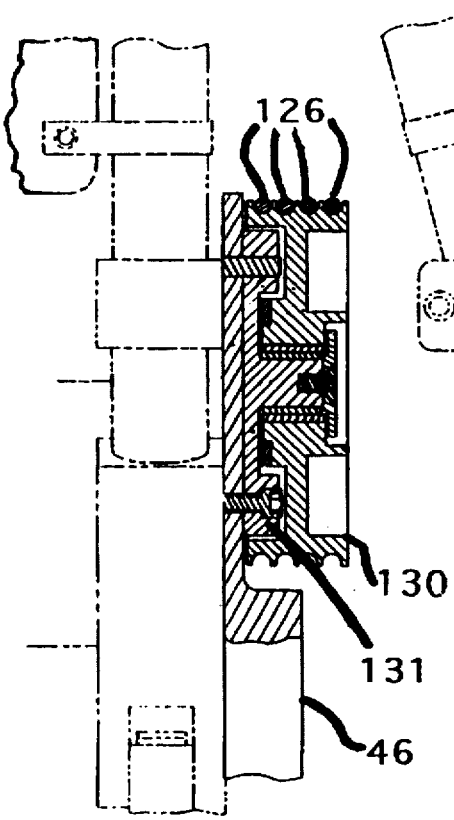
FIG. 9 is a rear sectional view taken along the line 9—9 of FIG. 8.
Figure 8:
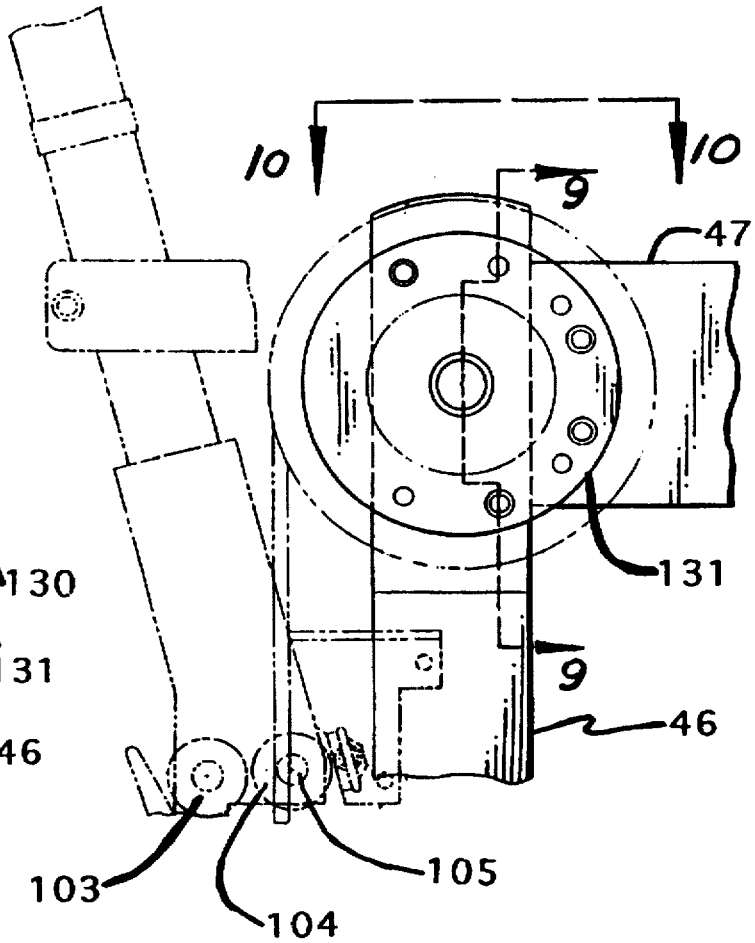
FIG. 8 is an enlarged side elevational view of the rear pulley construction illustrated in the chain line rectangle 8—8 of FIG. 2.

The horizontal runs 141 of the drive cables 126 are trained around pulleys 130 (FIG. 9) having groove spacing which is identical to the drive pulleys 122 and are mounted on idler pulley stub shafts 131 fixed to the rear pair of L-shaped pulley mounts 46.

The lower terminal ends 132 (FIG. 1) of the cables 126 are fixed to the rear top portions 133 of the rear vertical guide blocks 52.

Due to the pulley construction, the chair can be constructed to provide a 20 inch wide seat area but yet allow the seat to go through a 30 inch door opening.

The structure is such that the rolling chair 40 can be moved from a level of approximately 10 inches from the floor 37 to a raised position illustrated in solid lines in FIG.

3 which is 27 inches off the floor. By utilizing four smaller cables instead of one large cable, the thick cable increases the stress and thus shortens the life of the cable. With smaller diameter cables and large pulley diameters, the cable fatigue life is exponentially increased.

STABILIZING APPARATUS

Stabilizing apparatus, generally designated 134, FIG. 3 is provided and includes a forward hollow longitudinally extending, rectangular cylindrical guide 135 mounted between the wheel assemblies 38*a* or 38*b* and the frame bars 42 and 43 via brackets 136. The tubes 135 are mounted on mounting brackets 136 sandwiched between the lower side rails 42, 43 and the wheel assemblies 38.

A rear stabilizing bar 137 is slidably mounted within each forward hollow tubes 135 for sliding movement between the forward position, illustrated in FIG. 2, and the rearward stabilizing positions, illustrated in FIG. 3. A safety ball 138 depends from the rear end 139 of the bar 137 for bearing against the surface 37 to be traversed. When the patient 32 sits on the chair in the cantileverly supported transfer position, illustrated in FIG. 3, the downward force exerted on the frame will tend to tip the frame counter clockwise; as viewed in FIG. 3, about the wheels 38*b*. The safety supports and stabilizing bars 137 will preclude the frame 36 from tipping about the rear wheels 38*b*.

THE OPERATION

Referring now more particularly to FIGS. 26–31, initially, the wheelchair 30 will be configured and positioned as illustrated in FIGS. 1, 3 and 25, adjacent a patient's bed 34. As illustrated, the cloth seat 93 spans the frame bars 88 and held thereto via wedges 94 and the back rest cloth 110 is in the lowered back rest position.

Figure 27:
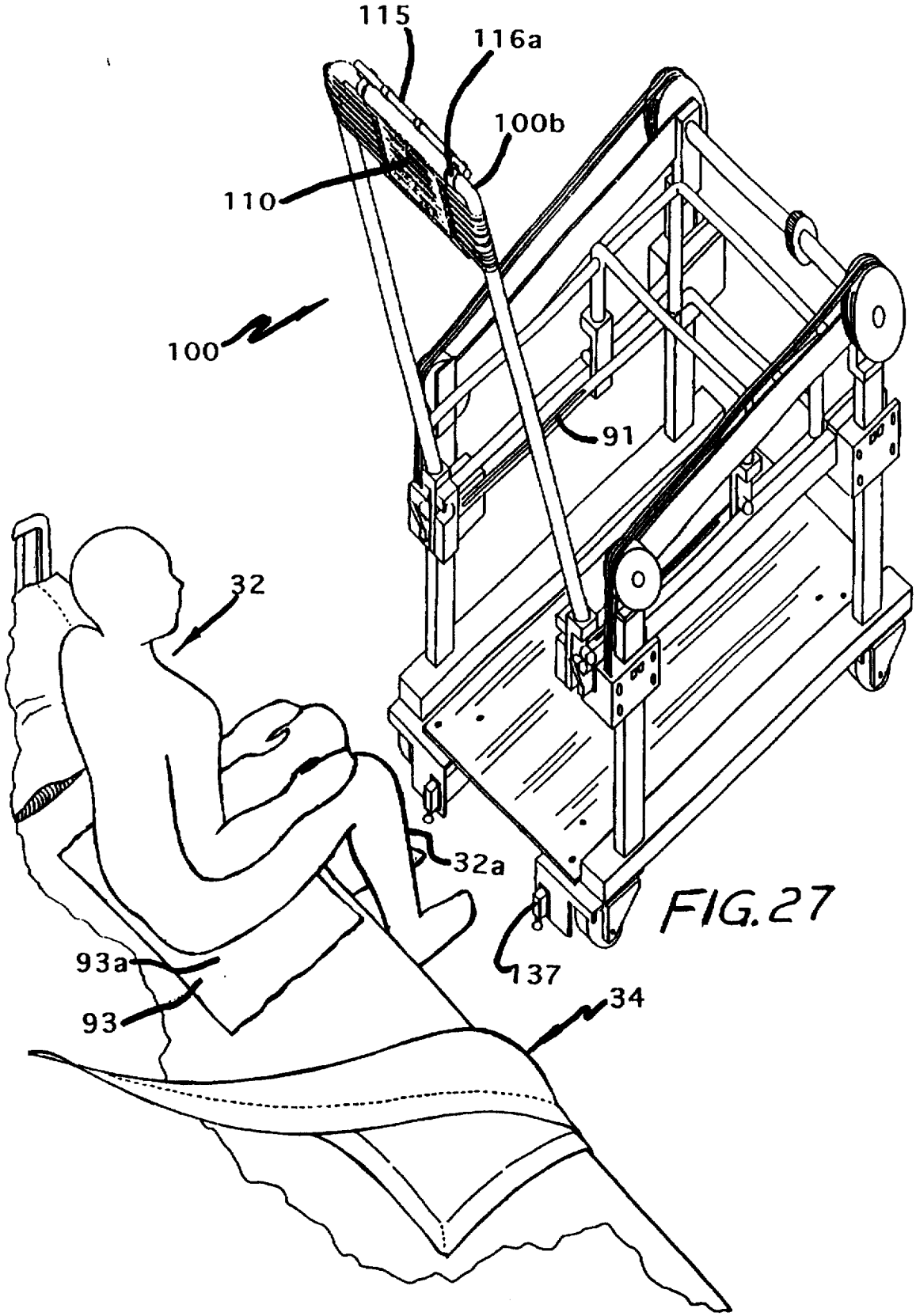

The wedges 94 are then moved upwardly out of the chair frame slots 91 to release the lateral cloth seat edges 92 and stowed in the positions illustrated in chain lines in FIG. 13. The cloth seat 93 is then transferred to a position on the bed as illustrated in FIG. 27. The patient 32 will then be rolled and maneuvered upwardly from a prone or rest position, illustrated in FIG. 26, to a sitting position on the top 93*a* of the cloth seat which rests on the bed 34 (FIG. 27). The patient 32 is then sitting in an upright position with his legs 32*a* along side the bed in a forwardly facing position facing the rear of the main frame 36.

The cloth back support 110 is also then moved to the raised position at the top of the chair frame 100 (FIG. 27) and the back support tie down bar 115 is mounted on the storage clips 116*a* at the top cross bar 100*b*.

Figure 28:
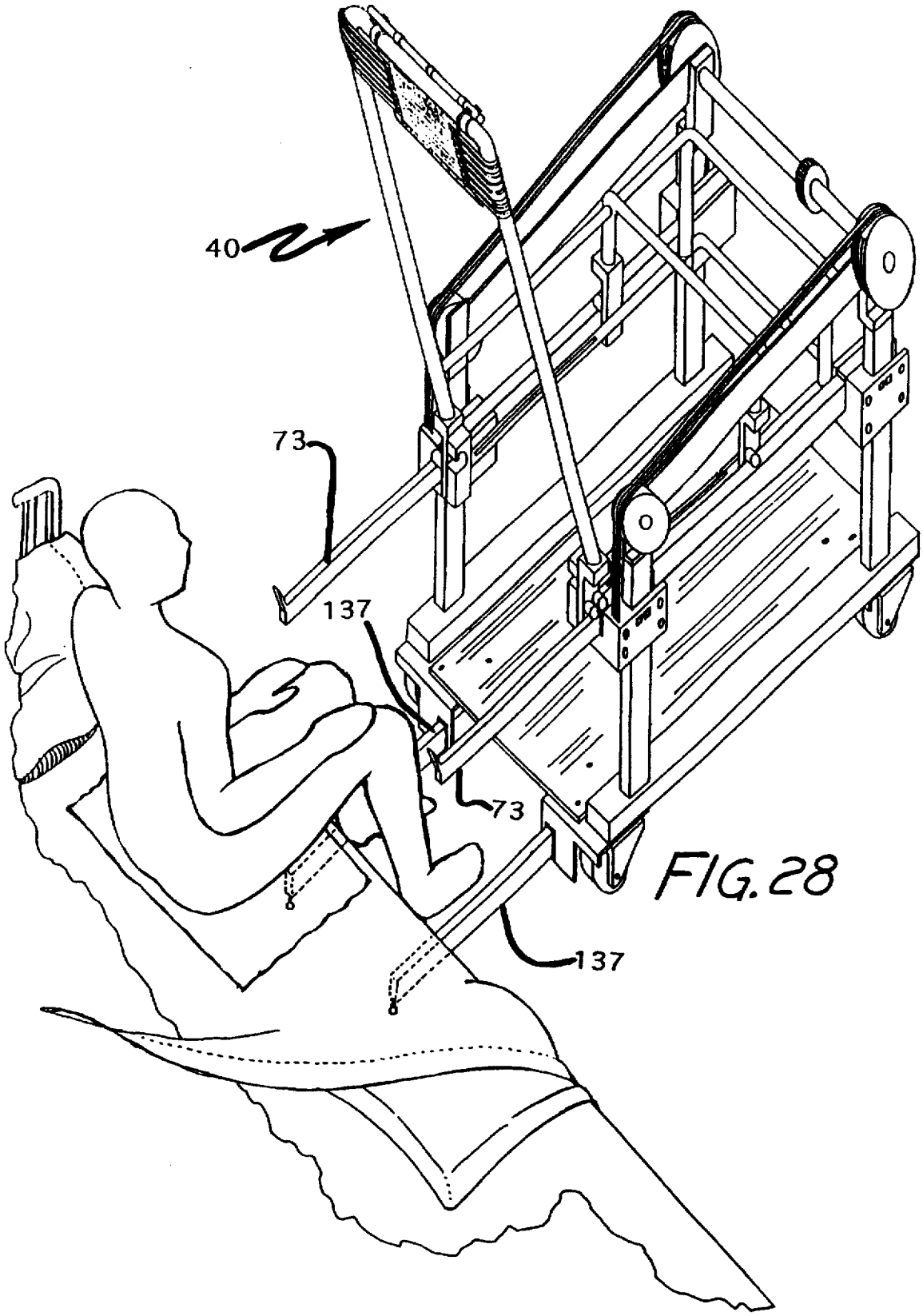

Referring now more particularly to FIG. 28, the stabilizing safety bars 137 are then extended rearwardly outwardly relative to the main frame 36 to the stabilizing positions illustrated in FIG. 28. The rear, chair supporting tracks 73 are then extended outwardly to the cantileverly supported rearward transfer positions illustrated in FIG. 28.

Figure 29:
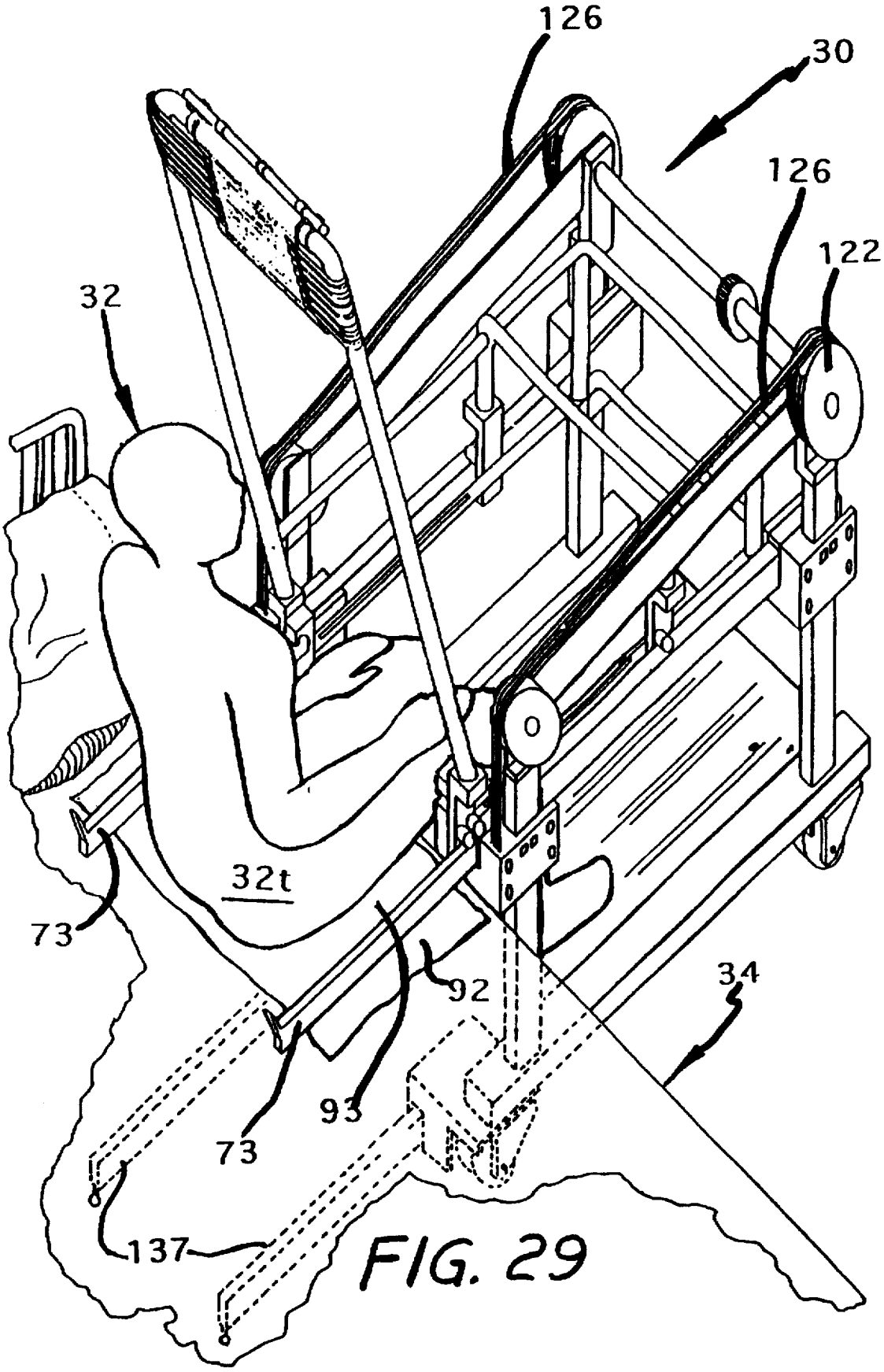

The entire wheelchair 40 is thence moved rearwardly toward the bed 34 so that the stabilizing bars 137 pass beneath the bed 34 and a person 32 seated on the bed and the extended track members 73 are disposed above the bed on opposite sides of a person 32 seated on the bed (FIG. 29).

Figure 30:
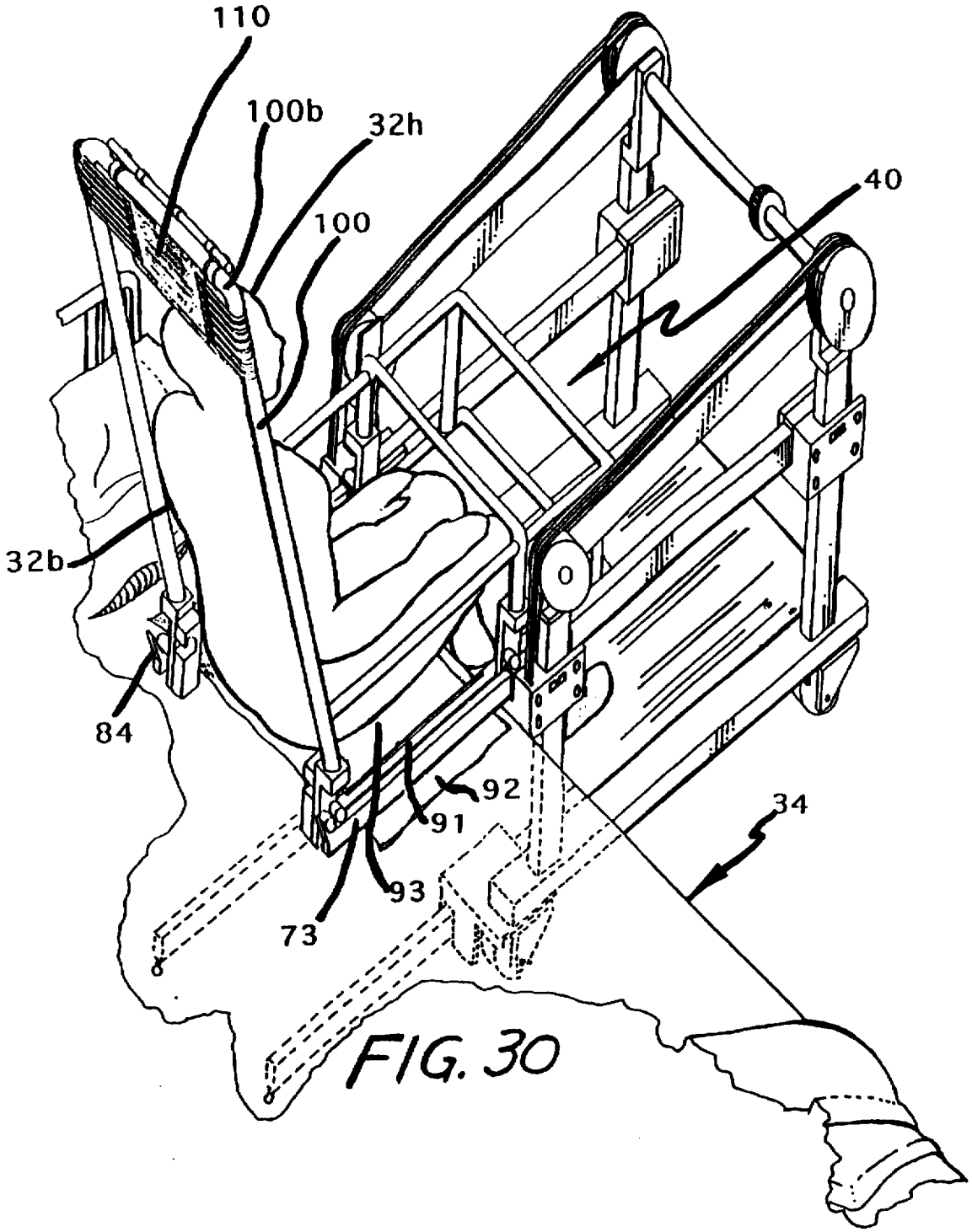

Referring now more particularly to FIG. 30, the chair 40 is thence rolled rearwardly on the chair supporting track members 73 to the patient transfer position illustrated until it comes to rest against the rear track stops 84 and the back frame 100 and cloth back 110 are disposed rearwardly of the back 32*b* of a person 32 seated on the bed 34. As illustrated, the frame 100 is constructed such that the top back frame bar 100*b* and cloth back support 110 have been positioned sufficiently high so that a patient's head 32*h* can pass beneath the elevated back support 110.

Figure 31:
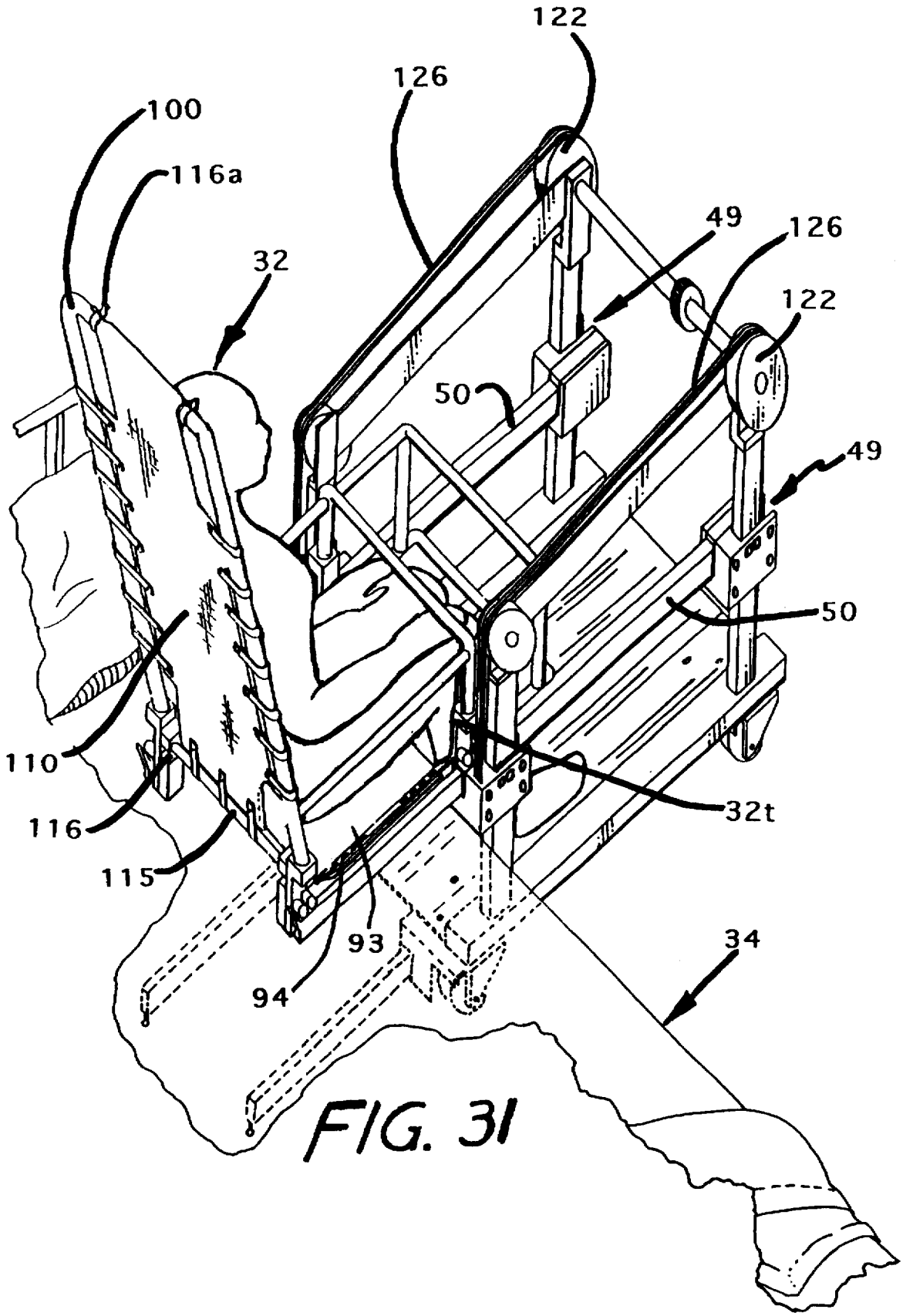

Referring now particularly to FIG. 31, the motor 119 (FIG. 4) is then operated to drive the drive pulleys 122, cables 126 to lower the sub-frame 49, and track assembly 50 supported thereon, to a position in which the rear tracks 73 are adjacent to or resting on the upper surface of the bed 34. The tracks 73 are then astride the thighs 32*h* of a person 32 seated on the bed, as illustrated in FIG. 31. The back support tie down bar 115 will then be removed from the clips 116*a* and moved downwardly to be received by the slots 116. The cloth back support 10 moves downwardly with bar 115 to the back supporting position illustrated in FIG. 31 wherein the back support 110 is taut on the frame 100.

The lateral seat edges 92 are then clamped into the slots 91 on the chair frame via the clamp bars for wedges 94 to secure the cloth seats 93 to the rolling chair frame.

Figure 31A:
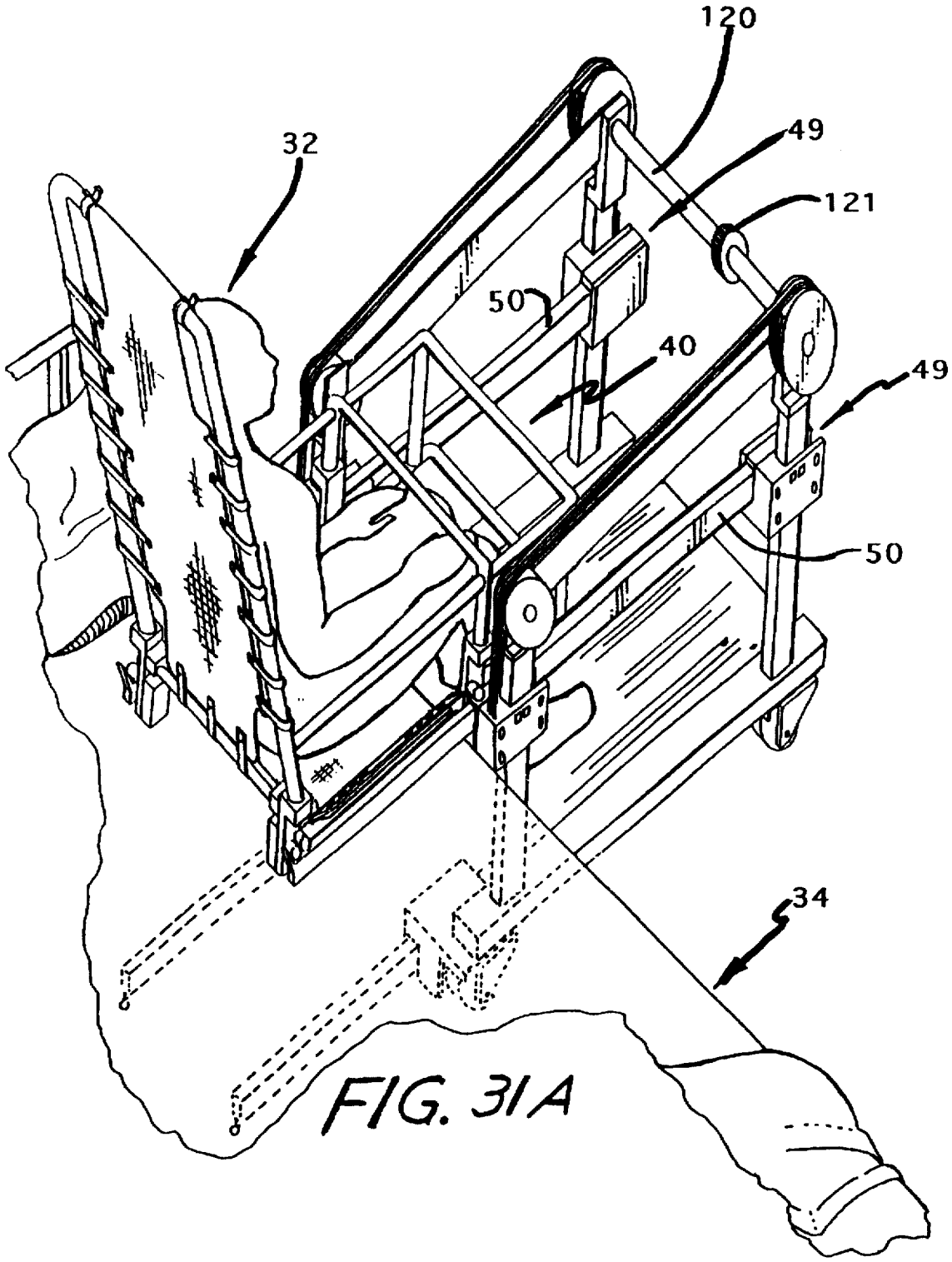
FIG. 31A is a similar rear perspective view illustrating a subsequent step in the transfer sequence and more particularly illustrates the tracks, chair, and a patient having been lifted upwardly and above the bed.

The motor 119 is then reversely operated to drive the gear 121 and shaft 120 to raise the sub-frame 49 and track assembly 50 and chair 40 and person 32 supported thereon to a position removed from the bed to the position illustrated in FIG. 31A.

Figure 32:
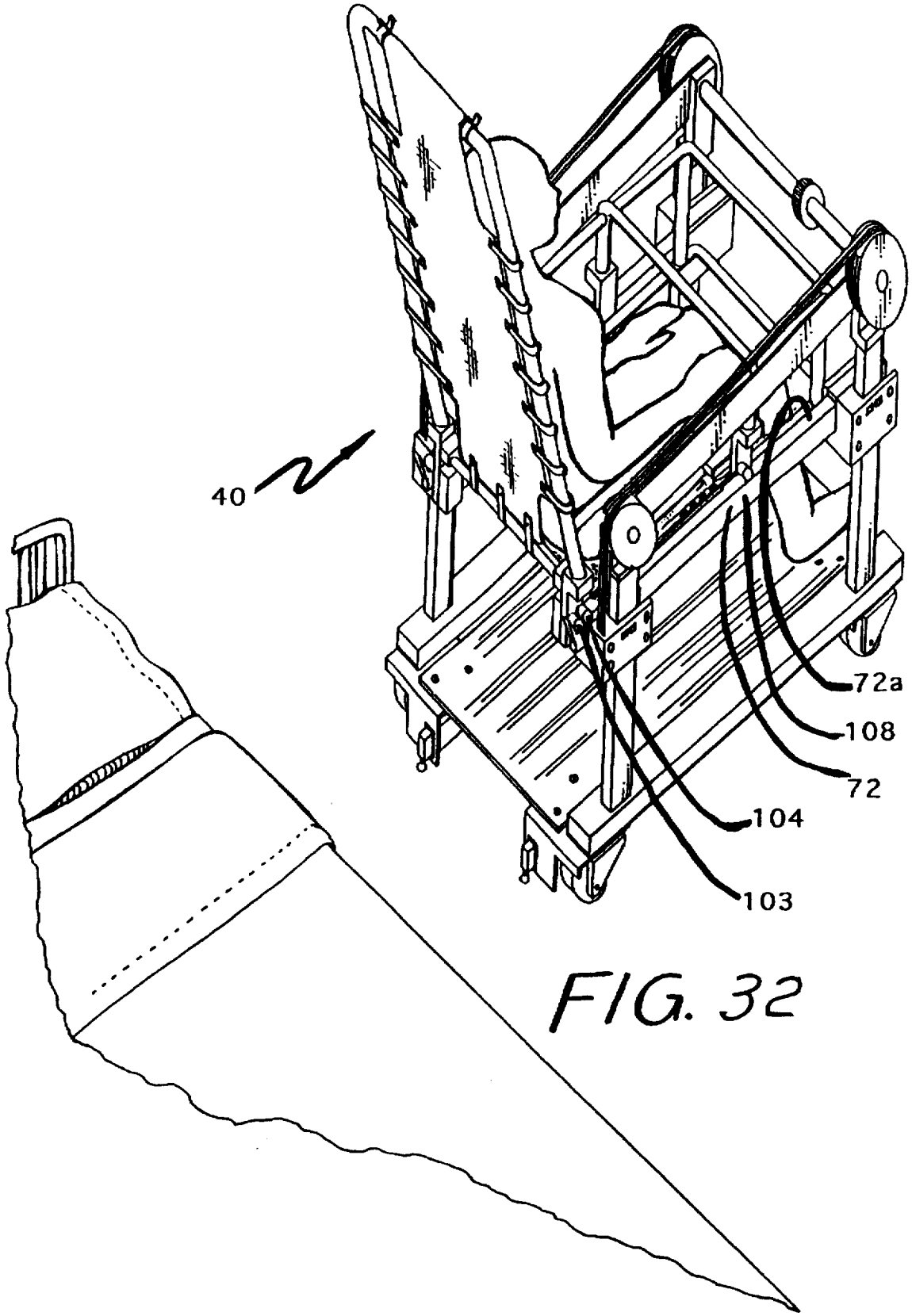

Referring now more particularly to FIG. 32, the rolling chair 40 with the patient 32 thereon is then forwardly moved. The rollers 103 will initially ride on the upper surface 73*a* of the rear tracks 73 and the front rollers 108 will ride on the upper surface 72*a* of the front track surfaces 72.

When the chair reaches its near forward position, the rollers 104 will bear against the ramps 75 to raise the rear portion of the chair 40 upwardly off the rear tracks 73.

The use of the guide blocks 51 and rollers 55, 56, 58*a* and 59*a* substitute a moment (FIG. 14) for the downward force which would otherwise be required for equilibrium and greatly reduces the upward pulley force required for equilibrium. This moment is the product of the resisting force (F1) of roller 55 multiplied by the vertical distance between the centerlines of roller 55 and roller 59*a*. For equilibrium, the resisting force F1 of roller 55 equals the resisting force F2 of roller 59*a*. The forces F1 and F2 are located at the roller horizontal centerlines. This allows the size and weight of the pulleys 122 and 130 to be reduced which allows more sitting room for the person 32 occupying the wheelchair.

The patient 32 has thus been transferred from the bed onto the rolling wheel frame 36 without the necessity of lifting the patient manually.

In order to remove the person from the wheelchair, the steps are reversed.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What is claim is:

1. A rear loaded and unloaded wheelchair comprising:

a mainframe including a front end and a rear end;

means mounting said mainframe for transitional movement on a support surface;

a chair for supporting a person to be transported including a seat having front and rear portions and a back rest extending upwardly from said rear portion of said seat;

said mainframe including a rearwardly opening, open-ended slot for receiving said seat and a person supported thereby; and sub-frame means, on said main frame, mounting said chair for forward and rearward movement between a forward, person transporting position, received by said slot, and a rearward, cantileverly supported, transfer position rearwardly removed from said slot.

2. The rear loaded and unloaded wheelchair set forth in claim 1 where at least one of said seat and said backrest is removably mounted on said sub-frame means.

3. The rear loaded and unloaded wheelchair set forth in claim 1 wherein said chair includes laterally spaced apart side frame members spanned by said seat and said backrest, mount means mounting at least one of said seat and backrest for movement relative to said side frame members between person supporting positions supported by said side frame members and removed positions in which a person, seated on an object such as a bed, can pass between said side frame members as said chair is rearwardly moved to said rearward transfer position.

4. The rear loaded and unloaded wheelchair set forth in claim 3 wherein said mount means includes means detachably mounting said seat on said side frame members and means slidably mounting said back rest on said side frame members between a lowered, back support position and a raised, non-support position overlying a person, seated on an object such as a bed, as said chair is moved to said rearward transfer position.

5. The rear loaded and unloaded wheelchair set forth in claim 3 wherein said sub-frame means includes extensible and retractable chair support means movable in a forward and rearward path of travel relative to said main frame between a forward position in which said chair is received by said slot and a rearward position in which said chair is rearward of said main frame and said slot.

6. The rear loaded and unloaded wheelchair set forth in claim 5 wherein said extensible and retractible chair support means includes means for bodily carrying said chair in a forward and rearward path relative to said frame and means mounting said chair for movement in a forward and rearward path relative to said extensible and retractible chair support means.

7. The rear loaded and unloaded wheelchair set forth in claim 1 including means mounting said sub-frame means for vertical movement on said mainframe to selectively lift and lower said seat and a person supported by said seat.

8. The rear loaded and unloaded wheelchair set forth in claim 1 including stabilizing means extending rearwardly of said main frame for bearing against said support surface to preclude tipping of said main frame when said chair is in said rearward, cantileverly supported, transfer position.

9. The rear loaded and unloaded wheelchair set forth in claim 8 wherein said stabilizing means comprises rail members movably mounted on said mainframe between rearward, stabilizing positions and forward, stored positions.

10. A rear loaded and unloaded wheelchair comprising:

a main frame including a front end and a rear end;

means mounting said main frame for transitional movement on a support surface;

chair means having a chair frame including laterally spaced apart side frame members including seat frame portions, and upstanding back support frame portions, a seat detachably mounted on said seat frame portions for movement between a forward body supporting position supported by said seat frame portion and a rearward, remote position, rearward of said main frame, supported by an object, such as a bed; and sub-frame means on, and extending rearwardly of, said main frame for supporting said chair frame for movement between a forward transport position and a rearward, cantileverly supported, transfer position adjacent said seat in said remote position whereby said seat in said rearward remote position can be detachably coupled to said sub-frame to transfer said seat, and a person seated thereon, from said remote position rearward to said forward, body supporting position.

11. The rear loaded and unloaded wheelchair set forth in claim 10 including means mounting said sub-frame means for vertical movement on said main frame to lift said seat and a person seated thereon from said object.

12. The rear loaded and unloaded wheelchair set forth in claim 11 wherein said sub-frame means comprises a pair of laterally spaced apart tracks extensible and retractible between extended, cantileverly supported positions, and forward stowed positions; and means mounting said said chair means on said tracks for movement therewith and for movement relative thereto.

13. The rear loaded and unloaded wheelchair set forth in claim 12 wherein each of said tracks comprise first and second telescopically mounted bars relatively moveable between generally coextensive positions and extended positions; said means mounting said chair means including first and rear wheel means rollingly received by said first and second bars respectively.

14. The rear loaded and unloaded wheelchair set forth in claim 13 including additional roller means mounted on said chair frame adjacent, but forwardly of, said rear wheel means, for raising said chair frame and for moving said rear wheel means upwardly off said second bar to support said chair frame on said front bar only.

15. A rear loaded and unloaded wheelchair comprising:

a main frame, having a front end and a rear end;

means for supporting said main frame for transitional movement along a support surface;

chair means for supporting a person in a forwardly facing position on said frame; and sub-frame means mounting said chair means on said main frame for forward and rearward movement thereon between a rearward, transfer position in which said chair means is cantileverly supported rearward of said main frame for loading and unloading a person, and a forward rest position, coextensive with said main frame, in which a person will rest for transport as said main frame moves along said support surface.

16. The rear loaded and unloaded wheelchair set forth in claim 15 wherein said means mounting said chair means on said main frame means comprises rail means mounting said chair means for forward and rearward movement relative to said main frame and for forward and rearward movement relative to said rail means.

17. The rear loaded and unloaded wheelchair set forth in claim 15 wherein said means mounting said chair means on said main frame means comprises extensible and contractible means movable between a contracted rest position, generally coextensive with said main frame, and a rearward transfer position extending rearwardly of said main frame.

18. The rear loaded and unloaded wheelchair set forth in claim 15 wherein said chair means comprises a chair frame having an open front.

19. The rear loaded and unloaded wheelchair set forth in claim 15 wherein said chair means comprises base means on which a person is seated, a pair of laterally spaced side rails defining a forwardly opening, open-ended slot for receiving a person seated on the base means; and means for detachably coupling said base means to said side rails.

20. The rear loaded and unloaded wheelchair set forth in claim 15 wherein said chair means comprises seat frame means, a seat, means for detachably coupling said seat to said seat frame means.

21. The rear loaded and unloaded wheelchair set forth in claim 20 wherein said frame means is extensible between a forward position overlying said main frame and a rearward transfer position supporting said chair means in said transfer position.

22. The rear loaded and unloaded wheelchair in claim 20 wherein said chair means includes laterally spaced apart side rails spaced apart by a gap to allow a person to be received therebetween when said seat is detached from said seat frame means.

23. The rear loaded and unloaded wheelchair set forth in claim 22 wherein said seat frame means includes generally horizontal side rails and upstanding, laterally spaced apart back support, side rails, and a back rest support mounted on said upstanding back support rails for movement between a lowered, back rest position adjacent said horizontal side rails and a raised position.

24. The rear loaded and unloaded wheelchair set forth in claim 15 including means mounting said sub-frame means on said main frame for vertical movement thereon between a lowered position and raised position.

25. Wheelchair apparatus for rear loading and unloading a person between a bed and a rear end of a wheeled main frame for transport comprising:

portable seat means for supporting a person, said seat means being adapted to be placed onto a bed so that a bedridden person can be rolled between a prone position on the bed and a sitting position on said seat means;

a main frame having a forward end and a rearward end;

wheel means mounting said main frame for transitional movement along a support surface, seat support frame means mounted on said main frame for forward and rearward movement between a forward, patient transport position overlying said main frame rearward transfer position adjacent said portable seat means on said bed; and means for detachably coupling said portable seat means to said seat support frame means in said rearward transfer position whereby said portable seat means and a person seated thereon, can be forwardly carried by said seat support frame means from said bed to said patient transport position on said main frame means.

26. The wheelchair apparatus set forth in claim 25 including means for raising and lowering said seat support frame means relative to said main frame means to lift said seat means, and the person support thereby, to an elevated position removed from said bed.

27. The wheelchair apparatus set forth in claim 25 including extensive and contractible stabilizing means mounted on said frame for movement between a stabilizing position, rearward of frame for engaging said surface and a retracted, forwardly disposed, stowed position.

28. The wheelchair apparatus set forth in claim 25 wherein said wheeled frame includes a rearwardly opening, opening for receiving said portable seat means and a person thereon in said patient transport position.

29. The wheelchair apparatus set forth in claim 27 wherein said seat support frame means comprises a chair frame having laterally spaced apart side frame members including seat frame portions for detached mounting said portable seat means and upstanding back frame portions; and back rest support means slidably mounted on said upstanding back frame portions for movement and between a lowered back supporting position for supporting the back of a person sitting on said seat and a raised position.

30. A rear loaded and unloaded wheelchair comprising:

a main frame having a front end, and a rear end;

means mounting said main frame for transitional movement in a forward and rearward path travel over a support surface;

a chair including a seat having a front end and a back end and an upstanding back support extending upwardly from said back end of said seat;

said seat including laterally spaced side frame members, a base, and means detachably mounting said base on said laterally spaced apart frame members for forward and rearward movement relative to said main frame between a forward body supporting position spanning said frame members and a body loading position removed from said frame members to transfer said seat, and a person, seated on an object such as a bed, to forwardly pass between said side frame members as said main frame is moved rearwardly;

a portion of said back support being moveable relative to said seat, in said body supporting position, from a back rest position adjacent said seat and raised, chair loading position removed from said seat to allow said person to be loaded through said back end of said seat;

a sub-frame for supporting said chair, and means for mounting said sub-frame on said main frame for forward and rearward movement relative to said main frame between a forward position on said main frame, and a rearward position in which said chair is disposed rearwardly of said main frame.

31. A rear loaded and unloaded wheelchair comprising:

a main frame assembly having a front end, a rear end, and means for transitional movement over a support surface;

a seat configured and maneuverable to support a person in a forwardly facing direction on a bed with the persons legs overhanging a side of the bed; and backloading means on said main frame assembly for forwardly moving said seat, and person thereon, from said bed relative to said main frame assembly through said rear end of said main frame assembly to be supported by said main frame assembly for movement therewith;

said backloading means comprising seat frame means;

means for detachably coupling said seat to said seat frame means to be carried therewith;

a secondary frame assembly for supporting said seat frame means on said main frame assembly for forward and rearward movement between a transfer position, rearward of said main frame assembly and adjacent said seat on said bed, and a forward transporting position;

said secondary frame assembly being extensible and contractible in a forward and rearward path on said main frame assembly between a rearwardly disposed position relative to said main frame assembly to cantileverly support said seat rearwardly of said main frame assembly and a forward position.

32. The rear loaded and unloaded wheelchair set forth in claim 31 wherein said secondary frame assembly is vertically movably mounted on said main frame assembly, and means is provided for vertically moving said secondary frame assembly on said main frame assembly.

33. The rear loaded and unloaded wheelchair set forth in claim 31 wherein said seat frame means includes laterally spaced apart seat frame members mounting said seat, laterally spaced apart back frame members extending upwardly from rear portions of said seat frame members, and back rest support means, spanning said back frame members, movable between a lowered, back supporting position and a raised position allowing a person supported by said seat on said bed to pass thereunder.

34. The rear loaded and unloaded wheelchair set forth in claim 31 wherein said seat frame means comprises laterally spaced apart side rails for receiving and passing a person supported by said seat on said bed as said seat frame means moves from said forward position to said transfer position.

35. The rear loaded and unloaded wheelchair set forth in claim 34 wherein said secondary frame assembly comprises laterally extensible and retractable spaced apart tracks, and means mounting said seat for rolling movement on said tracks.

36. A rear loaded and unloaded wheelchair comprising:

a main frame having a front end, and a rear end;

means mounting said main frame for transitional movement in a forward and rearward path travel over a support surface;

a chair including a seat having a front end and a back end and an upstanding back support extending upwardly from said back end of said seat;

said seat including laterally spaced side frame members, a base, and means detachably mounting said base on said laterally spaced apart frame members for forward and rearward movement relative to said main frame between a forward body supporting position spanning said frame members and a body loading position removed from said frame members to transfer said seat, and a person, seated on an object such as a bed, to forwardly pass between said side frame members as said main frame is moved rearwardly;

a portion of said back support being movable relative to said seat, in said body supporting position, from a back rest position adjacent said seat and a raised, chair loading position removed from said seat to allow said person to be loaded through said back end of said seat;

a sub-frame for supporting said chair on said main frame for movement between a forward position on said main frame and a transfer position rearward of said main frame.

37. The rear loaded and unloaded wheelchair set forth in claim 36 wherein said sub-frame includes laterally spaced apart rails extensible between a forward, retracted position and a rearward extended position; said chair including rollers mounting on said chair for rolling movement on said rails in said rearward extended position.

38. The rear loaded and unloaded wheelchair set forth in claim 37 wherein said rails are mounted on said main frame for vertical movement relative thereto.

39. A rear loaded and unloaded wheelchair comprising:

a main frame having a front end and a rear end;

means mounting said main frame for transitional movement over a support surface;

a chair including a chair frame having laterally spaced apart side frame members including laterally spaced apart seat frame members provided with front and rear portions, and laterally spaced apart upstanding back support frame members extending upwardly from said rear portion of said frame members;

body supporting means mounted on said side frame members for movement relative thereto between a body supporting position in which said chair and a person can be seated thereon and supported by said chair and removed position in which a person to be loaded onto the chair can pass between said upstanding back support frame members to a position between said laterally spaced apart seat members;

said body supporting means including a seat, and means detachably mounting said seat on said frame members, and back rest support means mounted on said upstanding back support frame members for vertical movement between a lowered position for supporting the back of a person on said seat and a raised position allowing a person to pass thereunder; and a sub-frame on said main frame mounting said chair frame for rolling movement thereon, said sub-frame being extensible and contractible on said main frame for movement between a forward, retracted position and a rearward, extended, transfer position in which said chair is cantileverly support rearwardly of said main frame.

40. The rear loaded and unloaded wheelchair set forth in claim 39 including means for vertically moving said sub-frame relative to said main frame.

41. The rear loaded and unloaded wheelchair set forth in claim 39 including stabilizing means extending rearwardly of said main frame for engaging the support surface to prevent tipping of said main frame when said chair is cantileverly supported.

42. A rear loaded and unloaded wheelchair comprising:

a main frame having a front end, a rear end, and means for transitional movement over a support surface;

a chair mounted on said main frame including a seat frame having a forwardly and rearwardly opening passage therethrough to allow a person to forwardly pass therethrough from rear to front relative to said seat frame;

a seat;

means detachably mounting said seat on said seat frame for supporting a person disposed in said passage, an upstanding back support frame mounted on said seat frame; and extensible and retractable, secondary chair support frame means mounted on said main frame for forward and rearward movement between a cantileverly supported, position, rearward of said main frame, and a forward stowed position for supporting said chair for forward and rearward movement on said main frame between a rearward transfer position rearward of said main frame and a forward position overlying said main frame.

43. The rear loaded and unloaded wheelchair set forth in claim 42 including stabilizing means extending rearwardly of said main frame for bearing against the support surface to stabilize said main frame when said chair is in said rearward transfer position.

44. The rear loaded and unloaded wheelchair set forth in claim 43 wherein said stabilizing means is extensible and retractable between an extended position substantially rearward of said main frame and a retracted, forward position.

45. The rear loaded and unloaded wheelchair set forth in claim 42 including means mounting said secondary frame means for vertical movement on said main frame in said transfer position.

46. The rear loaded and unloaded wheelchair set forth in claim 42 wherein said secondary frame means comprises laterally spaced apart, extensible and retractable rail members, and means mounting said chair for rolling movement on said rail members.

47. The rear loaded and unloaded wheelchair set forth in claim 46 including drive means on said main frame for selectively raising and lowering said rail members to selectively raise and lower said chair.

48. The rear loaded and unloaded wheelchair set forth in claim 47 wherein said drive means comprises a plurality of pulleys and a plurality of belts trained around said pulleys.

49. The rear loaded and unloaded wheelchair set forth in claim 48 wherein said belts comprises a plurality of laterally adjacent cables have adjacent terminal ends which are circumferentially staggered and fixed to one of the pulleys.

50. The rear loaded and unloaded wheelchair set forth in claim 42 wherein back support means is mounted on said seat frame for sliding movement between a lowered body supporting position adjacent said seat and a raised, person transfer position allowing the back support frame to pass rearwardly or forwardly of the person.

51. The rear loaded and unloaded wheelchair set forth in claim 42 wherein said seat comprises a flaccid sheet of material, and said means for detachably mounting said seat on said seat frame comprises means for detachably coupling said flaccid sheet of material to said seat frame.

52. The rear loaded and unloaded wheelchair set forth in claim 51 wherein said chair includes back support means slidably mounted on said back frame for vertical movement between a lowered, back supporting position and a raised, non-blocking position overlying a person to be loaded.

53. A rear loaded and unloaded wheelchair comprising:

a main frame having a front end and a rear end provided with a rearwardly facing, opening therein;

means mounting said main frame for transitional movement along a support surface;

means movably mounted on said main frame for transferring a forwardly facing person sitting rearwardly of said main frame on an object, such as a bed, relative to said main frame in a forward direction from said object to a forward rest position on said main frame received by said rearwardly facing, opening;

said means for transferring including a seat configured and maneuverable to underlie and support a forwardly facing person on said object in a rearward position rearward of said main frame; and sub-frame means mounted on said main frame for forward and rearward movement thereon between a rearward transfer position, in which said seat in said rearward position is cantileverly support by said main frame, and a forward position in which said seat, and a person supported thereby, is forwardly transferred through said rear end of said main frame to be received by said rearwardly opening, opening in said rest position.

54. The wheelchair set forth in claim 53 including means for detachably coupling said seat to said sub-frame means when said sub-frame means is in said rearward transfer position.

55. The wheelchair set forth in claim 54 wherein said sub-frame means includes laterally spaced apart rail means forwardly and rearwardly extensible and contractible on said main frame between a forward, retracted condition and a rearward, extended position for receiving a person sitting on said seat.

56. The wheelchair set forth in claim 55 wherein said sub-frame means is mounted for vertical movement on said main frame; and means is provided for vertically moving said sub-frame means relative to said main frame to lift said seat, and a person supported thereby, from said object for forward movement to said rest position.

57. The wheelchair set forth in claim 53 wherein including a chair frame having laterally spaced apart side frame members adapted to receive a person sitting on said seat, and means for detachably coupling said seat to said side frame members in said rearward transfer position.

58. The wheelchair set forth in claim 57 wherein said side frame members include generally horizontal side rails on which said seat is detachably mounted and upstanding laterally spaced side rails extending upwardly from a rear portion of said horizontal side rails, and back rest support means is mounted on said upstanding side rails for movement between a back rest position spanning said upstanding side rails adjacent said horizontal side rails and a raised position allowing said upstanding side rails to pass rearwardly or forwardly of the person.

59. The wheelchair set forth in claim 57 including means mounting said sub-frame means on said main frame for vertical movement thereon; and means is provided for vertically moving said sub-frame means in said rearward transfer position to left said seat and a person support thereon from said object.

60. A rear loaded and unloaded wheelchair for transferring a person to and from an object such as a bed, couch, or automobile seat, comprising:

a main frame having a front end, a rear end, and means for transitional movement over a support surface;

a seat configured and maneuverable to support a person in a forwardly facing position on said object with the person's legs overhanging said object;

means for transferring a person between a position sitting on said seat and forward position supported by said frame including a sub-frame mounted on said main frame for vertical movement between raised and lowered positions, extensible and contractible track means mounted on said sub-frame for movement between a forward position and a rearward, transfer position adjacent said seat on said object;

a seat frame mounted on said track means for movement thereon between a forward rest position and a transfer position cantileverly supported rearward of said main frame;

means for vertically moving said sub-frame, said track means, and said seat frame thereon between said raised position and said lowered position to selectively lower a rearward terminal end portion of said track means adjacent said object; and means for detachably coupling said seat to said seat frame in said lowered, cantileverly supported, transfer position so that a person supported by said seat can be moved vertically relative to said object and moved forwardly and rearwardly relative to said object to said forward position supported by said main frame for transport therewith.

61. The rear loaded and unloaded wheelchair set forth in claim 60 wherein said seat comprises a chair frame having laterally spaced apart side rails defining an open rear for receiving a patient between said rails and body support means detachably mounted on said side rails for detachable supporting a person between said side rails.

62. The rear loaded and unloaded wheelchair set forth in claim 61 wherein said rails of said chair frame each comprise an elongate, generally horizontal bar having an upwardly opening slot therein; and wedge means is removably received by said upwardly opening slot for clamping a lateral edge portion of said seat to said bar.

63. The wheelchair set forth in claim 62 including storage rack means on each side of said seat frame for storing said wedge means when said wedge means is removed from said slot.

64. The rear loaded and unloaded wheelchair set forth in claim 60 wherein said track means comprises first and second frame bars on each side of said seat frame, said first and second frame bars being telescopically mounted for relative forward and rearward movement.

65. The rear loaded and unloaded wheelchair set forth in claim 60 wherein said track means is mounted on each lateral side of said seat frame and includes a first tubular bar and a second bar telescopically received by said first tubular bar.

66. The rear loaded and unloaded wheelchair set forth in claim 65 front and rear wheel means are provided on each side of said seat frame and are mounted on said laterally spaced tracks for rolling movement thereon.

67. The wheelchair set forth in claim 66 wherein said from wheel means are rollingly received on said first and second bars respectively when said seat frame is in said transfer position.

68. The rear loaded and unloaded wheelchair set forth in claim 67 including additional wheel means mounted on said seat frame adjacent, but forwardly of, said rear wheel means for raising said seat frame and move said rear wheel means off said second bar to support a rear portion of said seat frame on said first bar only.

69. The rear loaded and unloaded wheelchair set forth in claim 68 wherein said first rail includes a rear terminal end portion which is rearwardly downwardly inclined providing a ramp for receiving said additional wheel means as said seat frame is moved from said transfer position to said forward rest position.

70. The rear loaded and unloaded wheelchair set forth in claim 60 wherein said main frame includes vertical tracks and said sub-frame includes guides thereon for guiding on said vertical tracks.

71. The rear loaded and unloaded wheelchair set forth in claim 60 wherein means is provided for vertically moving said sub-frame including a pulley having a plurality of laterally spaced annular circumferential grooves thereon, a plurality of cables of a predetermined width received in said grooves; and a plurality of anchors coupled to the terminal ends of said cables for coupling said terminal cable ends to said pulley, said anchors having an axial width substantially greater than the width of said cables; and means securing adjacent ones of said anchors to the pulley in circumferentially spaced relation.

72. The rear loaded and unloaded wheelchair set forth in claim 60 wherein said track means includes front and rear telescopically mounted tracks extensible between closed, telescoped forward positions, and rearward extended positions in which said rear track is cantileverly supported rearward of said forward track, and roller means mounting said seat frame on said front and rear tracks.

73. The rear loaded and unloaded wheelchair set forth in claim 72 wherein said roller means includes front rollers for riding along said forward tracks, rear rollers for supporting the rear portion of said chair on said rear tracks when said chair is in said rearward transfer position, and intermediate roller means for raising the rear rollers off said rear track and supporting the rear portion of said chair on the rear portion of said forward track when said chair is in said forward rest position.

74. The rear loaded and unloaded wheelchair set forth in claim 73 wherein the forward track includes a rear terminal end having a downwardly, rearwardly inclined ramp for receiving said intermediate roller means.

75. The wheelchair set forth in claim 73 including upstanding stop means on the rear terminal end of said tracks for interrupting rearward rolling movement of said chair on said track means.

* * * * *